US008783156B1

(12) United States Patent
Malone et al.

(10) Patent No.: US 8,783,156 B1
(45) **Date of Patent: *Jul. 22, 2014**

(54) VEHICLE AND STRUCTURE SHIELD WITH A CABLE FRAME

(71) Applicant: QinetiQ North America, Inc., Reston, VA (US)

(72) Inventors: Joseph Vincent Malone, Waltham, MA (US); Nicole Jean Baird, Lincoln, RI (US); Scott Robert Albin, Carlisle, MA (US); Robert G. Holmes, Jr., Worcester, MA (US)

(73) Assignee: Foster-Miller, Inc., Waltham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/873,839

(22) Filed: Apr. 30, 2013

Related U.S. Application Data

(63) Continuation of application No. 13/200,296, filed on Sep. 22, 2011, now Pat. No. 8,468,927, which is a continuation-in-part of application No. 12/807,532, filed on Sep. 8, 2010, now abandoned, which is a continuation-in-part of application No. 12/386,114, filed on Apr. 14, 2009, now Pat. No. 8,011,285.

(60) Provisional application No. 61/124,428, filed on Apr. 16, 2008.

(51) Int. Cl.
*F41H 7/02* (2006.01)

(52) U.S. Cl.
USPC ..... 89/36.08; 89/36.04; 89/36.11; 89/36.12; 89/918

(58) Field of Classification Search
USPC ..... 89/36.01–36.17; 109/49.5; 114/241; 296/187.07
See application file for complete search history.

(56) References Cited

U.S. PATENT DOCUMENTS

| | | | |
|---|---|---|---|
| 461,983 | A | 10/1891 | Parker |
| 1,198,035 | A | 9/1916 | Huntington |
| 1,204,547 | A | 11/1916 | Corrado et al. |
| 1,229,421 | A | 6/1917 | Downs |
| 1,235,076 | A | 7/1917 | Stanton |

(Continued)

FOREIGN PATENT DOCUMENTS

| | | |
|---|---|---|
| DE | 690167 | 4/1940 |
| DE | 2206404 | 10/1972 |

(Continued)

OTHER PUBLICATIONS

Written Opinion of the International Searching Authority mailed Jan. 7, 2010 for International Application No. PCT/US2009/002363, 5 pages, unnumbered.

(Continued)

*Primary Examiner* — Bret Hayes
*Assistant Examiner* — Joshua Freeman
(74) *Attorney, Agent, or Firm* — Iandiorio Teska & Coleman LLP

(57) ABSTRACT

An ordinance, such as a rocket propelled grenade, shield includes a net with hard points at select nodes of the net and cable guides on the side of the net. Cables under tension extend through the cable guides supporting the net typically in conjunction with a top cross bar, spaced top struts, and spaced bottom struts. This framis design facilitates entering and exiting the vehicle or structure.

66 Claims, 18 Drawing Sheets

(56) References Cited

U.S. PATENT DOCUMENTS 1,274,624 A 8/1918 Steinmetz
1,367,249 A 2/1921 Goodyear
1,385,897 A 7/1921 Tolmie
1,552,269 A 9/1925 Brocker
2,100,211 A 11/1937 Feitosa
2,238,779 A 4/1941 Mosebach
2,296,980 A 9/1942 Carmichael
2,308,683 A 1/1943 Forbes
2,322,624 A 6/1943 Forbes
2,347,653 A 5/1944 Zuckermann
2,348,387 A 5/1944 Hume
3,129,632 A 4/1964 Starr
3,608,034 A 9/1971 Bramley et al.
3,633,936 A 1/1972 Huber
3,656,790 A 4/1972 Truesdell
3,656,791 A 4/1972 Truesdell
3,733,243 A 5/1973 Crawford
3,893,368 A 7/1975 Wales, Jr.
3,931,965 A 1/1976 Grant
3,950,584 A 4/1976 Bramley
3,961,789 A 6/1976 Tabacheck
3,992,628 A 11/1976 Karney
4,051,763 A 10/1977 Thomanek
4,157,411 A 6/1979 Thomson
4,253,132 A 2/1981 Cover
4,262,595 A 4/1981 Longerich
4,358,984 A 11/1982 Winblad
4,399,430 A 8/1983 Kitchen
4,411,462 A 10/1983 Buehrig et al.
4,625,668 A 12/1986 Fitch
4,688,024 A 8/1987 Gadde
4,768,417 A 9/1988 Wright
4,912,869 A 4/1990 Govett
4,928,575 A 5/1990 Smirlock et al.
4,950,198 A 8/1990 Repko, Jr.
4,986,389 A 1/1991 Halligan, Sr. et al.
4,997,185 A 3/1991 Bartasius
5,007,326 A 4/1991 Gooch, Jr. et al.
5,025,707 A 6/1991 Gonzalez
5,039,159 A 8/1991 Bonner
5,069,109 A 12/1991 Lavan, Jr.
5,078,117 A 1/1992 Cover
5,094,170 A 3/1992 Raynaud et al.
5,170,690 A 12/1992 Smirlock et al.
5,191,166 A 3/1993 Smirlock et al.
5,192,111 A 3/1993 Hanemaayer
5,197,239 A 3/1993 Glynn et al.
5,215,310 A 6/1993 Allbright
5,269,623 A 12/1993 Hanson
5,279,199 A 1/1994 August
5,291,715 A 3/1994 Basile
5,321,922 A 6/1994 Popp et al.
5,333,532 A 8/1994 Smirlock et al.
5,342,021 A 8/1994 Watson
5,370,035 A 12/1994 Madden, Jr.
5,394,786 A 3/1995 Gettle et al.
5,400,688 A 3/1995 Eninger et al.
5,435,226 A 7/1995 McQuilkin
5,441,239 A 8/1995 Watson
5,524,524 A 6/1996 Richards et al.
5,578,784 A 11/1996 Karr et al.
5,583,311 A 12/1996 Rieger
5,609,528 A 3/1997 Kehoe
5,622,455 A 4/1997 Anderson et al.
5,646,613 A 7/1997 Cho
5,705,058 A 1/1998 Fischer
5,725,265 A 3/1998 Baber
5,739,458 A 4/1998 Girard
5,750,918 A 5/1998 Mangolds et al.
5,792,976 A 8/1998 Genovese
5,842,939 A 12/1998 Pui et al.
5,898,125 A 4/1999 Mangolds et al.
5,924,723 A 7/1999 Brantman et al.
5,947,831 A 9/1999 McCarthy
5,984,121 A * 11/1999 Cole ..... 211/183
5,988,036 A 11/1999 Mangolds et al.
6,029,558 A 2/2000 Stevens et al.
6,062,617 A 5/2000 Marks
6,119,574 A 9/2000 Burkey et al.
6,128,999 A 10/2000 Sepp et al.
6,131,873 A 10/2000 Blazon et al.
6,279,499 B1 8/2001 Griffith, Sr. et al.
6,282,860 B1 9/2001 Ramirez
6,311,605 B1 11/2001 Kellner et al.
6,325,015 B1 12/2001 Garcia et al.
6,374,565 B1 4/2002 Warren
6,375,251 B1 4/2002 Taghaddos
6,394,016 B2 5/2002 Swartout et al.
6,443,489 B1 9/2002 Ehrenberger et al.
6,494,246 B1 12/2002 Blevins
6,499,796 B1 12/2002 Eenhoorn
6,595,102 B2 7/2003 Stevens et al.
6,626,077 B1 9/2003 Gilbert
6,647,855 B1 11/2003 Christiansen et al.
6,672,220 B2 1/2004 Brooks et al.
6,782,792 B1 8/2004 Edberg et al.
6,805,035 B2 10/2004 Edberg et al.
6,805,187 B2 10/2004 Padiak et al.
6,854,374 B1 2/2005 Breazeale
6,901,839 B2 6/2005 Edberg et al.
6,904,838 B1 6/2005 Dindl
6,925,771 B2 8/2005 Lee et al.
6,951,348 B2 10/2005 Enders
6,957,602 B1 10/2005 Koenig et al.
7,169,718 B1 1/2007 Rexroad
7,177,518 B2 2/2007 Chun
7,190,304 B1 3/2007 Carlson
7,244,199 B1 7/2007 Romano
7,302,739 B2 12/2007 Christiansson
7,308,738 B2 12/2007 Barvosa-Carter et al.
7,318,258 B2 1/2008 Chun
7,328,644 B2 2/2008 Vickroy
7,412,916 B2 8/2008 Lloyd
7,415,917 B2 8/2008 Lloyd
7,513,186 B2 4/2009 Ravid et al.
7,866,248 B2 1/2011 Moore, III et al.
7,866,250 B2 1/2011 Farinella et al.
7,971,422 B2 7/2011 Shnayder et al.
8,011,285 B2 9/2011 Farinella et al.
8,082,835 B2 12/2011 Soukos
8,132,495 B2 3/2012 Joynt
8,172,707 B2 5/2012 Cox
8,297,193 B1 10/2012 Lawson et al.
8,365,803 B2 2/2013 Schoenheit et al.
8,407,868 B2 4/2013 Chung
2001/0032577 A1 10/2001 Swartout et al.
2001/0048102 A1 12/2001 Telles
2002/0134365 A1 9/2002 Gray
2003/0217502 A1 11/2003 Hansen
2004/0016846 A1 1/2004 Blackwell-Thompson et al.
2004/0212217 A1 10/2004 Caccuci et al.
2005/0011396 A1 1/2005 Burdette et al.
2005/0016372 A1 1/2005 Kilvert
2005/0090338 A1 4/2005 Scarpa, III
2005/0155194 A1 7/2005 Christiansson
2005/0278098 A1 12/2005 Breed
2006/0065111 A1 3/2006 Henry
2006/0112817 A1 6/2006 Lloyd
2006/0200954 A1 9/2006 Chung
2007/0057495 A1 3/2007 Tesch et al.
2007/0089597 A1 4/2007 Ma
2007/0180983 A1 8/2007 Farinella et al.
2008/0164379 A1 7/2008 Wartmann et al.
2008/0231067 A1 9/2008 Nagle
2008/0257141 A1 10/2008 Medwell et al.
2008/0258063 A1 10/2008 Rapanotti
2009/0084284 A1 4/2009 Martinez et al.
2009/0104422 A1 4/2009 Sampson
2009/0173250 A1 7/2009 Marscher et al.
2009/0178597 A1 7/2009 Silwa, Jr.
2009/0217811 A1 9/2009 Leeming
2009/0266226 A1 10/2009 Beach et al.
2009/0266227 A1 10/2009 Farinella et al.
2009/0308238 A1 12/2009 Schwartz

(56) References Cited

U.S. PATENT DOCUMENTS

| | | | | |
|---|---|---|---|---|
| 2010/0224055 | A1 | 9/2010 | Soukos | |
| 2010/0282935 | A1 | 11/2010 | Zannoni | |
| 2010/0288114 | A1* | 11/2010 | Soukos | 89/36.02 |
| 2010/0294122 | A1 | 11/2010 | Hoadley et al. | |
| 2010/0294124 | A1 | 11/2010 | Wentzel | |
| 2010/0307328 | A1 | 12/2010 | Hoadley et al. | |
| 2010/0319524 | A1 | 12/2010 | Farinella et al. | |
| 2011/0067561 | A1 | 3/2011 | Joynt | |
| 2011/0079135 | A1 | 4/2011 | Farinella et al. | |
| 2011/0136087 | A1 | 6/2011 | Corridon | |
| 2011/0179944 | A1 | 7/2011 | Farinella et al. | |
| 2011/0185614 | A1 | 8/2011 | Laney et al. | |
| 2011/0192014 | A1 | 8/2011 | Holmes, Jr. et al. | |
| 2011/0203453 | A1 | 8/2011 | Farinella et al. | |
| 2011/0252955 | A1 | 10/2011 | Radstake et al. | |
| 2012/0004056 | A1 | 1/2012 | Cox | |
| 2012/0011993 | A1 | 1/2012 | Malone et al. | |
| 2012/0011994 | A1 | 1/2012 | Hoadley et al. | |
| 2012/0046916 | A1 | 2/2012 | Farinella et al. | |
| 2012/0067199 | A1 | 3/2012 | Farinella et al. | |
| 2012/0152101 | A1 | 6/2012 | Engleman et al. | |
| 2012/0180639 | A1 | 7/2012 | Farinella et al. | |
| 2012/0186436 | A1 | 7/2012 | Parida et al. | |
| 2012/0255431 | A1 | 10/2012 | Hubsch | |
| 2012/0291616 | A1 | 11/2012 | Andrewartha et al. | |

FOREIGN PATENT DOCUMENTS

| | | | |
|---|---|---|---|
| DE | 2409876 | | 9/1975 |
| DE | 2507351 | | 9/1976 |
| DE | 3722420 | | 1/1989 |
| DE | 3735426 | | 5/1989 |
| DE | 3834367 | | 4/1990 |
| DE | 4437412 | | 9/1995 |
| EP | 0655603 | | 5/1995 |
| EP | 0872705 | | 10/1998 |
| EP | 0902250 | | 3/1999 |
| FR | 2695467 | | 3/1994 |
| GB | 2449055 | | 11/2008 |
| WO | WO 99/30966 | | 6/1999 |
| WO | WO 2006/134407 | A1 | 12/2006 |
| WO | WO 2006/135432 | A2 | 12/2006 |
| WO | WO 2008/070001 | A2 | 6/2008 |
| WO | WO 2008/079001 | A1 | 7/2008 |

OTHER PUBLICATIONS

Written Opinion of the International Searching Authority mailed Dec. 23, 2011 for International Application No. PCT/US2011/01462, 6 pages, unnumbered.

File History of U.S. Patent Publication No. 2008/0164379 (through Mar. 1, 2011), 304 pages, unnumbered.

Written Opinion of the International Searching Authority mailed Jul. 27, 2012 in International Application No. PCT/US 2012/00227 (eight (8) pages total).

Written Opinion of the International Searching Authority mailed Nov. 13, 2012 for International Application No. PCT/US2011/01459, 5 pages, unnumbered.

Written Opinion of the International Searching Authority mailed Jan. 31, 2013 for International Application No. PCT/US2012/063207 (six (6) pages total).

* cited by examiner

VEHICLE AND STRUCTURE SHIELD WITH A CABLE FRAME

RELATED APPLICATIONS

This application is a continuation of U.S. patent application Ser. No. 13/200,296 filed Sep. 22, 2011 which hereby claims the benefit of and priority thereto under 35 U.S.C. §§119, 120, 363, 365, and 37 C.F.R. §1.55 and §1.78, which is a continuation-in-part of U.S. patent application Ser. No. 12/807,532 filed Sep. 8, 2010, which is a continuation-in-part of and claims benefit of and priority to U.S. patent application Ser. No. 12/386,114 filed Apr. 14, 2009, which claims the benefit of and priority to U.S. Provisional Application Ser. No. 61/124,428 filed Apr. 16, 2008.

GOVERNMENT RIGHTS

This invention was made with U.S. Government support under Contract No. HR0011-09-C-0017 awarded by DARPA. The Government has certain rights in the invention.

FIELD OF THE INVENTION

The subject invention relates to ordnance shielding.

BACKGROUND OF THE INVENTION

Rocket propelled grenades (RPGs) and other ordnance are used by terrorist groups to target military vehicles and structures. See WO 2006/134407 incorporated herein by this reference.

Others skilled in the art have designed intercept vehicles which deploy a net or a structure in the path of an RPG in an attempt to change its trajectory. See U.S. Pat. Nos. 7,190,304; 6,957,602; 5,578,784; and 7,328,644 all incorporated herein by this reference. Related prior art discloses the idea of deploying an airbag (U.S. Pat. No. 6,029,558) or a barrier (U.S. Pat. No. 6,279,499) in the trajectory path of a munition to deflect it. These references are also included herein by this reference.

Many such systems require detection of the RPG and deployment of the intercept vehicle quickly and correctly into the trajectory path of the RPG.

Static armor such as shown in U.S. Pat. Nos. 5,170,690; 5,191,166; 5,333,532; 4,928,575; and WO 2006/134,407 is often heavy and time consuming to install. When a significant amount of weight is added to a HMMWV, for example, it can become difficult to maneuver and top heavy. Such an armor equipped vehicle also burns an excessive amount of fuel.

Moreover, known static systems do not prevent detonation of the RPG. One exception is the steel grille armor of WO 2006/134,407 which is said to destroy and interrupt the electrical energy produced by the piezoelectric crystal in the firing head of the RPG. Bar/slat armor is also designed to dud an RPG. But, bar/slat armor is also very heavy. Often, a vehicle designed to be carried by a specific class of aircraft cannot be carried when outfitted with bar/slat armor. Also, if the bar/slat armor is hit with a strike, the RPG still detonates. Bar/slat armor, if damaged, can block doors, windows, and access hatches of a vehicle.

Chain link fence type shields have also been added to vehicles. The chain link fencing, however, is not sufficiently compliant to prevent detonation of an RPG if it strikes the fencing material. Chain like fencing, although lighter than bar/slat armor, is still fairly heavy. Neither bar/slat armor nor the chain link fence type shield is easy to install and remove.

Despite the technology described in the above prior art, Rocket Propelled Grenades (RPGs) and other threats used by enemy forces and insurgents remain a serious threat to troops on the battlefield, on city streets, and on country roads. RPG weapons are relatively inexpensive and widely available throughout the world. There are varieties of RPG warhead types, but the most prolific are the PG-7 and PG-7M which employ a focus blast or shaped charge warhead capable of penetrating considerable armor even if the warhead is detonated at standoffs up to 10 meters from a vehicle. A perfect hit with a shaped charge can penetrate a 12 inch thick steel plate. RPGs pose a persistent deadly threat to moving ground vehicles and stationary structures such as security check points.

Heavily armored, lightly armored, and unarmored vehicles have been proven vulnerable to the RPG shaped charge. Pick-up trucks, HMMWV's, 2½ ton trucks, 5 ton trucks, light armor vehicles, and M118 armored personnel carriers are frequently defeated by a single RPG shot. Even heavily armored vehicles such as the M1 Abrams Tank have been felled by a single RPG shot. The PG-7 and PG-7M are the most prolific class of warheads, accounting for a reported 90% of the engagements. RPG-18s, RPG-69s, and RPG-7Ls have been reported as well, accounting for a significant remainder of the threat encounters. Close engagements 30 meters away occur in less than 0.25 seconds and an impact speed ranging from 120-180 m/s. Engagements at 100 meters will reach a target in approximately 1.0 second and at impact speeds approaching 300 m/s.

The RPG-7 is in general use in Africa, Asia, and the Middle East and weapon caches are found in random locations making them available to the inexperienced insurgent. Today, the RPG threat in Iraq is present at every turn and caches have been found under bridges, in pickup trucks, buried by the road sides, and even in churches.

Armor plating on a vehicle does not always protect the occupants in the case of an RPG impact and no known countermeasure has proven effective. Systems designed to intercept and destroy an incoming threat are ineffective and/or expensive, complex, and unreliable.

Chain link fencing has been used in an attempt to dud RPGs by destroying the RPG nose cone. See, for example, DE 691,067. See also published U.S. Patent Application No. 2008/0164379. Others have proposed using netting to strangulate the RPG nose cone. See published U.S. Application No. 2009/0217811 and WO 2006/135432.

WO 2006/134407, insofar as it can be understood, discloses a protective grid with tooth shaped members. U.S. Pat. No. 6,311,605 discloses disruptive bodies secured to armor. The disruptive bodies are designed to penetrate into an interior region of a shaped charge to disrupt the formation of the jet. The shaped charge disclosed has a fuse/detonator mechanism in its tail end.

BRIEF SUMMARY OF THE INVENTION

No known prior art, however, discloses a net supporting a spaced array of hard points at a set off distance from a vehicle or a structure wherein the hard points are designed to dig or tear into the nose cone of an RPG and dud it.

Pending U.S. Patent Application Publication No. 2009/0266227, incorporated herein by this reference, discloses a novel vehicle protection system. The following reflects an enhancement to such a system.

In the field, if a hard point net is placed over a door, window, or other means of ingress or egress, it can be a slow process to remove the net from the frame and open the door or window in order to enter or exit the vehicle or structure. The same is true if it is desirable to remove one or more hard point nets and their frames for maneuvers, staging operations, transportation of a vehicle, or the like. The tubular frame members also add some weight to the vehicle or structure. Also, the frame members, if struck by an RPG, may cause detonation of the RPG.

In various aspects of the invention, in some embodiments, ingress and egress are made easier and a lighter weight system is provided. The subject invention results from the at least partial realization that, in one preferred embodiment, hard point nets with one or more cables serving as the frame components allow easier ingress, egress, provide improved coverage, and results in a lighter weight system. When two adjacent nets share the same cable, hard point coverage is even further improved.

The invention, in one example, includes a shield comprising a net including hard points at select nodes of the net. One or more sides of the net include a plurality of cable guides such as eyelets and at least one cable under tension extends through the cable guides supporting the net.

One specific design, the eyelets include a peripheral groove for receiving a net chord therein, the hard points include a body portion with a cavity and a plug received in the cavity, and a net chord extends between the plug and the body portion, around the eyelet groove, and back between the plug and the body portion. Typically, the hard points include slots in the body portion for the net chords.

Besides the cable(s), the framis for the net may include a top cross bar for supporting the net. In one version, spaced top struts interconnect the top cross bar with the vehicle or structure. In one example, the top cross bar includes a tensioning mechanism for the cable.

If the vehicle or structure includes a door, both top struts can be connected to the door or, alternatively, one top strut can be connected to the door and one top strut can be connected to the vehicle or structure. In the later design, the top struts are preferably pivotable with respect to the top cross bar and with respect to the door or vehicle structure.

The framis for the net, in some examples, includes spaced bottom struts for opposing sides of the net. In one example, the bottom struts are foldable with respect to the vehicle or structure and/or include a shock absorbing device. In one version, each bottom strut is connected to a net cable but the net cable is removable from its associated bottom strut. In but one example, a pin is removably received in a bottom strut and connected to the net. In one design, a cable extends through cable guides at the top and bottom of a first side of the net, over to a second side of the net and through cable guides at the bottom and top of the second side, to the top of the net, then through cable guides at the middle on the second side, then to the bottom of the net, over to the first side of the net, through cable guides of at the middle of the first side of the net, and then to the top of the net.

In another example, a member is provided for tensioning sides of the net and typically resides between the net and the vehicle or structure.

In several examples, a tray on the vehicle or structure is provided for storing the net. Typically, there are cable guides on opposing sides of the net and spaced cables, one on each side of the net. An adjacent net can be provided with cable guides and a cable then extends through the cable guides of both nets.

The invention also features a shield comprising a net with opposing sides of the net including a plurality of cable guides for supporting the net when a cable is provided under tension through the cable guides on each side of the net.

A method of manufacturing a shield, in accordance with one example, includes running chords of a net through a body portion of a hard point, direction the chord to a cable guide, redirecting the chord back between through the body portion of the hard point; and forcing a plus into the body portion of the hard point locking the chord therein. Preferably, the net chord is directed about the cable guide.

The invention also features a method of manufacturing a shield comprising securing hard points at select nodes of a net, adding cable guides to one or more sides of the net, and providing at least one cable under tension through the cable guides to support the net in a spaced relation with respect to a vehicle or structure.

One method includes supporting the net by a top cross bar and interconnecting the top cross bar with the vehicle or structure using spaced top struts. The method may further comprise making the top struts foldable with respect to the vehicle or structure. The method typically includes tensioning at least one cable. A method may include supporting the net via spaced bottom struts, making the bottom struts foldable with respect to the vehicle or structure, and/or equipping each bottom strut with a shock absorbing device. A bottom fabric portion may be provided for the net.

In one method, a member is provided for tensioning sides of the net and typically the member is placed between the net and the vehicle or structure.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
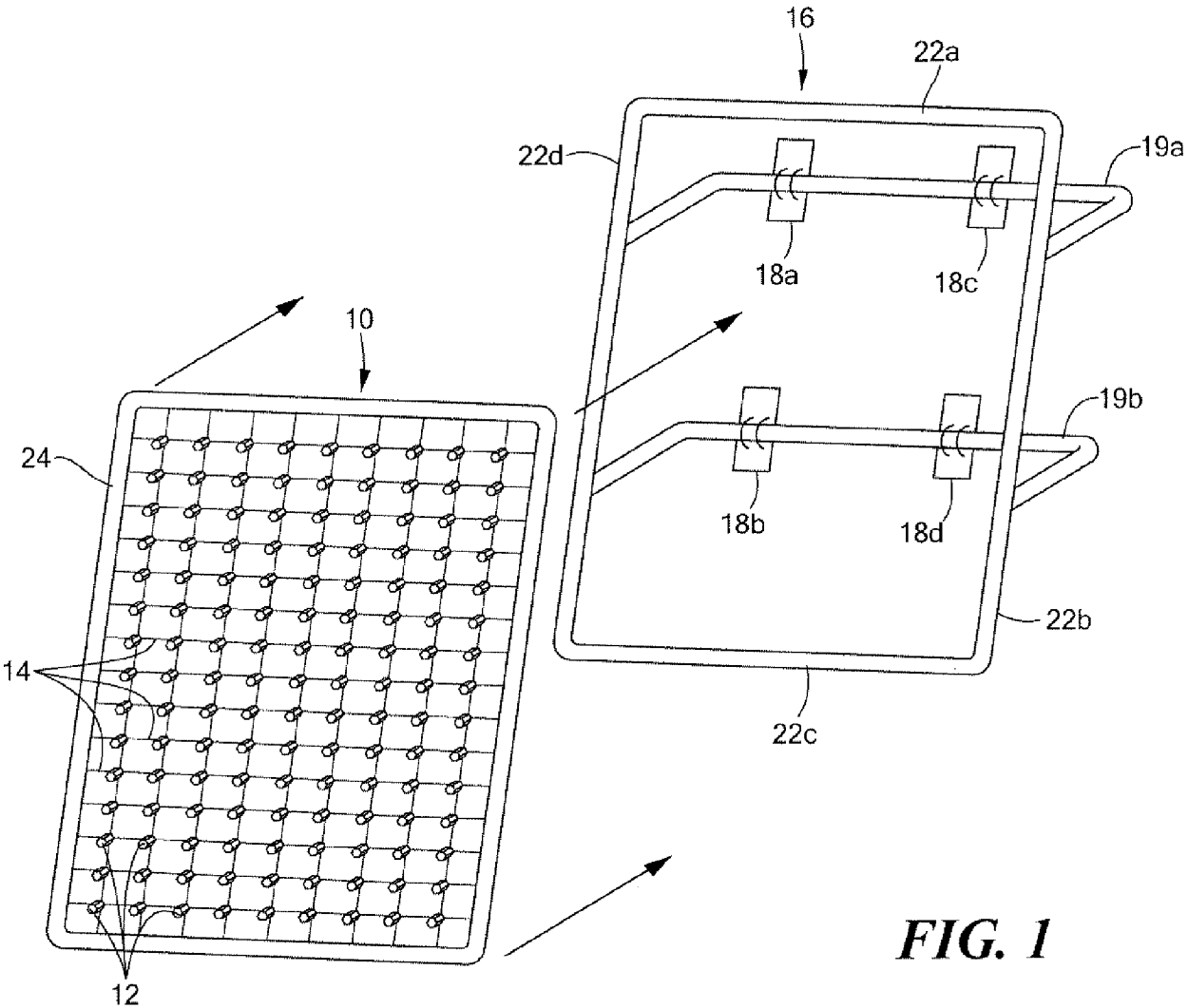
FIG. 1 is a schematic three-dimensional exploded view showing an example of a hard point net and a frame for the hard point net.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows an example net subsystem 10 and including an array of hard points 12 configured to impact a projectile (e.g., the nose cone of an RPG) striking net 14. In this example, there is a hard point 12 at each node of the net defined by intersecting net chords 14. Frame 16 includes mounting brackets 18*a*-18*d* attached to rearwardly extending members 19*a* and 19*b*. The function of frame 16 and net 14 is to position hard points 12 in a spaced relationship with respect to a vehicle or structure and to space the hard points 12 apart from each other in an array. When an RPG impacts net 14, hard points 12 may angle inwardly towards the nose of the RPG tearing into it and duding the electronics and/or electrical or electronic signals associated with the arming or detonation mechanisms of the RPG. By flexible, we generally mean a net which does not retain its shape unless supported in some fashion. When not attached to frame 16, net 14 can be rolled and then folded and/or net 14 can be bunched up.

Figure 2:
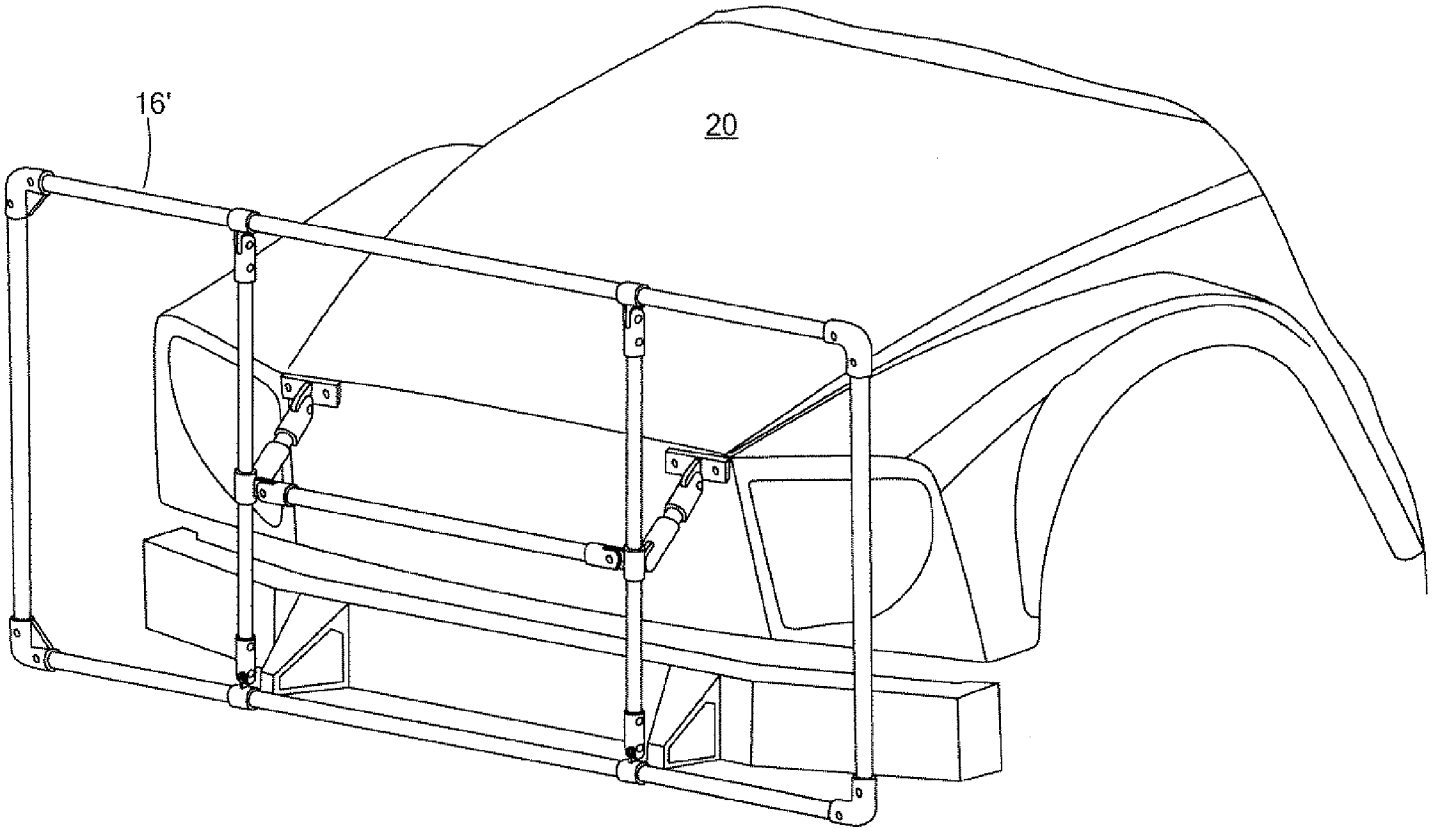
FIG. 2 is a schematic front view showing another frame structure for a hard point net attached at the front of a vehicle.

Preferably, net subsystem 10 is removeably secured to frame 16 and frame 16 is removeably secured to a vehicle (e.g., a HMMWV vehicle). In one particular example, tubular frame members 22*a*-22*d* include hook type fasteners secured to the outside thereof and the fabric net periphery 24, FIG. 1 includes loop type fasteners on the inside thereof. Loop type fasteners are also secured to the rear of frame 16 mounting brackets 18*a*-18*d* and corresponding pads or patches 28*a*-28*d*. FIG. 2, adhered to vehicle 20, include outer faces with hook type fasteners. The hook and loop fastening mechanisms, however, maybe reversed and other flexible fastener subsystems may also be used. The hook and loop fastening subsystems of U.S. Pat. Nos. 4,928,575; 5,170,690; 5,191,166; and 5,333,532 are preferred.

FIG. 2 shows another type of frame structure 16' attached to the front of vehicle 20.

If the frame structure of FIG. 1 or 2 is placed over a door, window, portal, or other means of ingress or egress, however, it can snake ingress to and egress from the vehicle or structure more complicated and/or slower and it can add time to conducting certain maneuvers, staging operations, transportation, or the like if the net and/or frame members need to be disassembled from the vehicle. The frame members shown in FIGS. 1 and 2 can also add weight to the vehicle and can cause detonation of an RPG or other ordinance.

Figure 3:
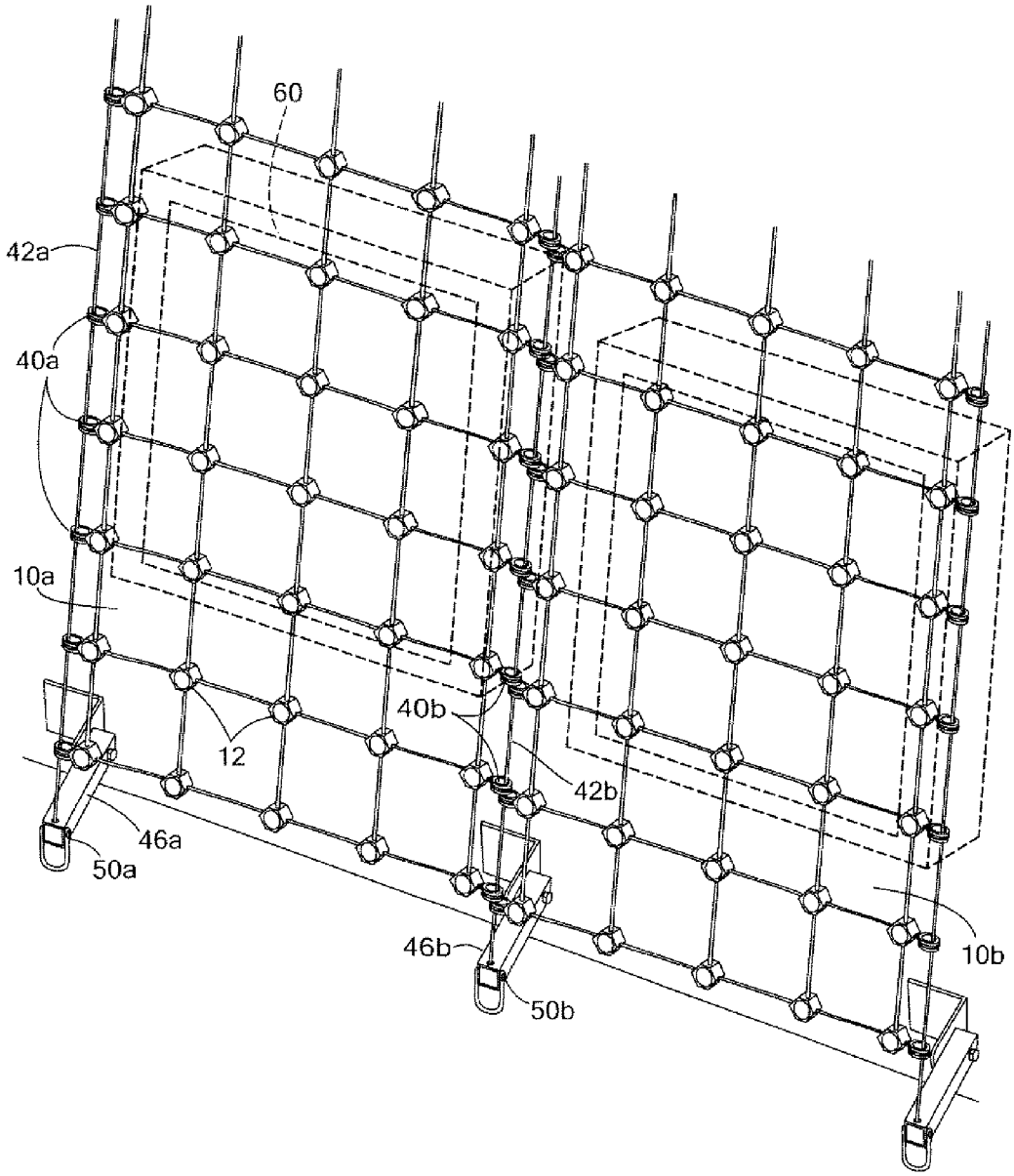
FIG. 3 is a schematic three-dimensional front view showing an example of two nets sharing the same cable wherein each net is attached to the cable via cable guides in accordance with an embodiment of the subject invention.

As shown in FIG. 3, new net 10*a* with hard points 12 at the nodes of the net also includes cable guides such as eyelets or grommets 40*a*, in this particular example, on one side of the net and eyelets 40*b* on the opposite side of the net. Cable 42*a* under tension extends through eyelets 40*a* and cable 42*b* under tension extends through eyelets 40*b*. The cables 42*a* and 42*b* may be made of metal, fabric, rope material, or the like. Bottom strut members 46*a* and 46*b* provide tension to cables 40*a* and 40*b*. Quick release pin 50*b*, for example, releasably couples cable 42*b* to strut member 46*b* and pin 50*b* can be pulled along with quick release pin 50*a* (which couples cable 42*a* to member 46*a*) and net 10 can then be rolled upwards providing for fairly quick and easy ingress to and egress from vehicle portal 60. Deploying the shield is also a fairly quick procedure. Struts 46*a* and 46*b* are typically secured to a vehicle below windows or portals 60 and are foldable with respect to the vehicle body.

Strut members 46*a* and 46*b* may also be designed to be easily removed from the vehicle structure via quick release pins and/or the like. Members 46 could also be pivotably attached to the vehicle or structure. Other means for securing the net to the one or more cables can also be used and there are other ways possible for tensioning the cables.

Figure 4:
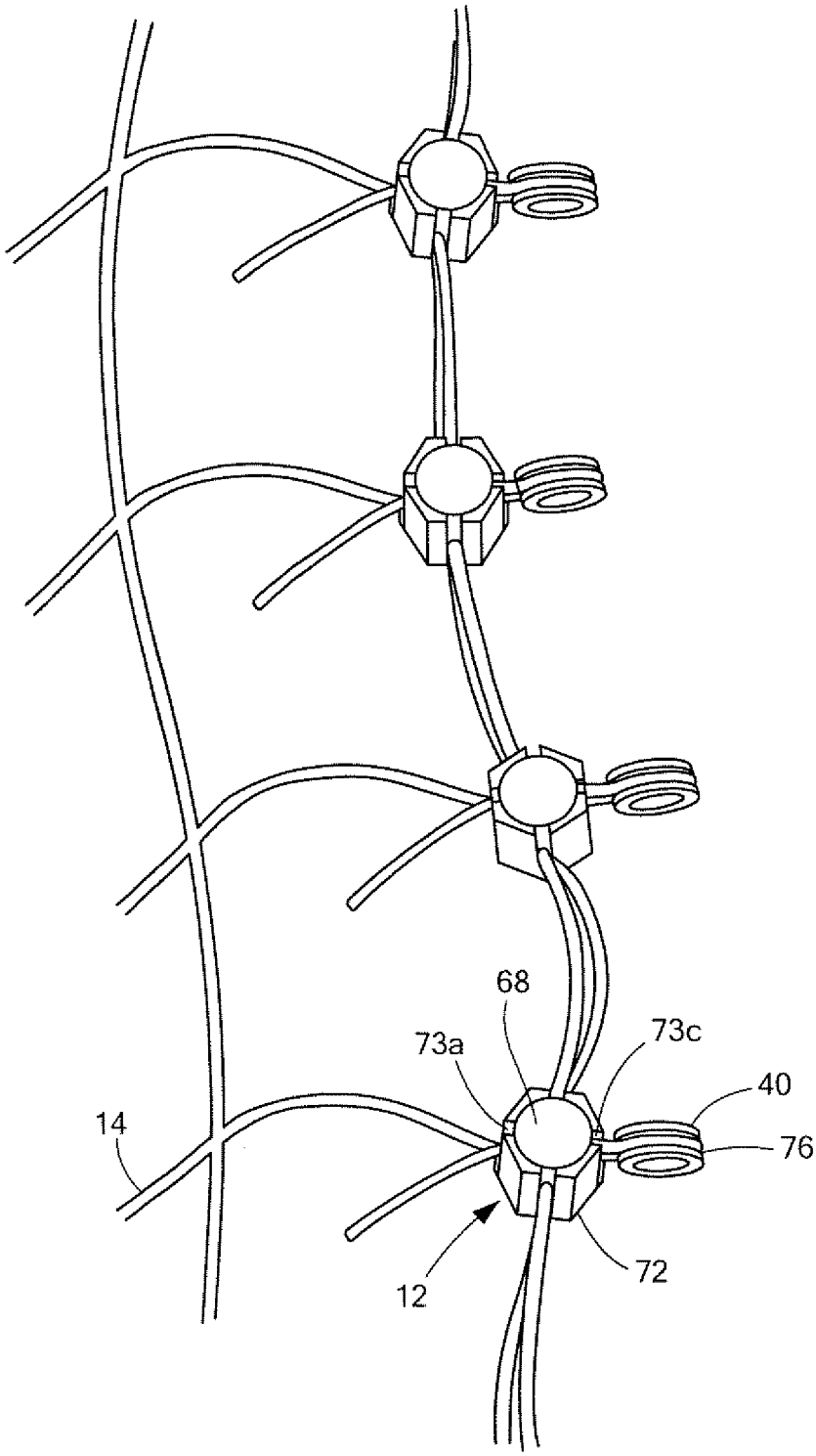
FIG. 4 is a schematic view showing a portion of one side (the top, bottom, or left or right hand side) of a hard point net in accordance with an example of the subject invention.

As shown more clearly in FIG. 4, hard points 12 preferably include a body portion 72 defining a cavity receiving plug 68 therein. Each eyelet 40 includes a peripheral groove as shown at 76 for receiving a net chord 14 therein. In this particular example, net chord 14 passes through slots 73*a* and 73*c* of body portion 72 of the hard point, around eyelet 40 and in its groove, and back through slot 73*c* and 73*a* of hard point body portion 72. Plug 68 is then press fit into the body portion. Note how closely the hard point is to eyelet 40. The coverage of the hard points is thus improved which results in increased protection especially when two nets 10*a* and 10*b* are placed adjacent each other as shown in FIG. 3. Cable 42*b* extends through the eyelets on the right hand side of net 10*a* and through the eyelets on the left hand side of net 10*b*. Other cable guide means, however, are possible. There are other ways to secure the cable guides to the net.

Figure 5A:
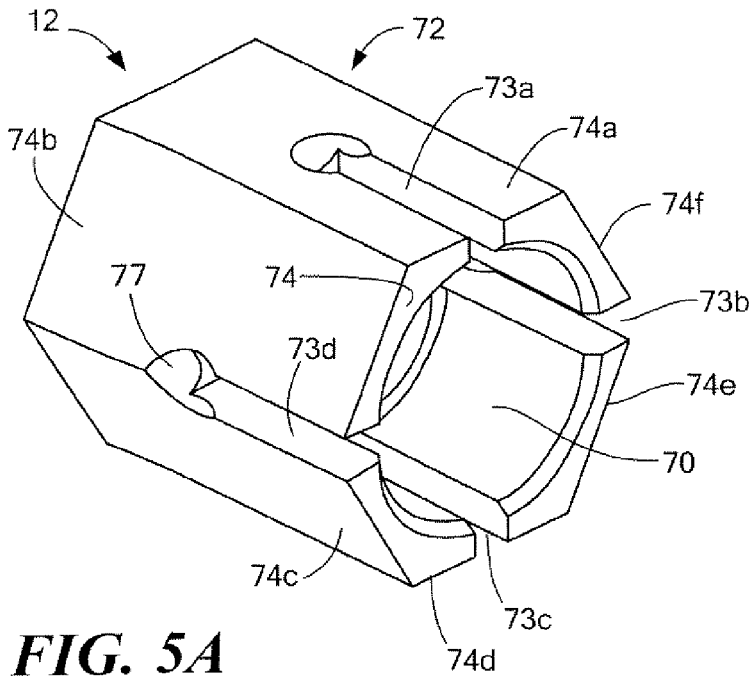
FIG. 5A is a schematic rearview showing a portion of a hard point in accordance with one preferred embodiment of the subject invention.
Figure 5B:
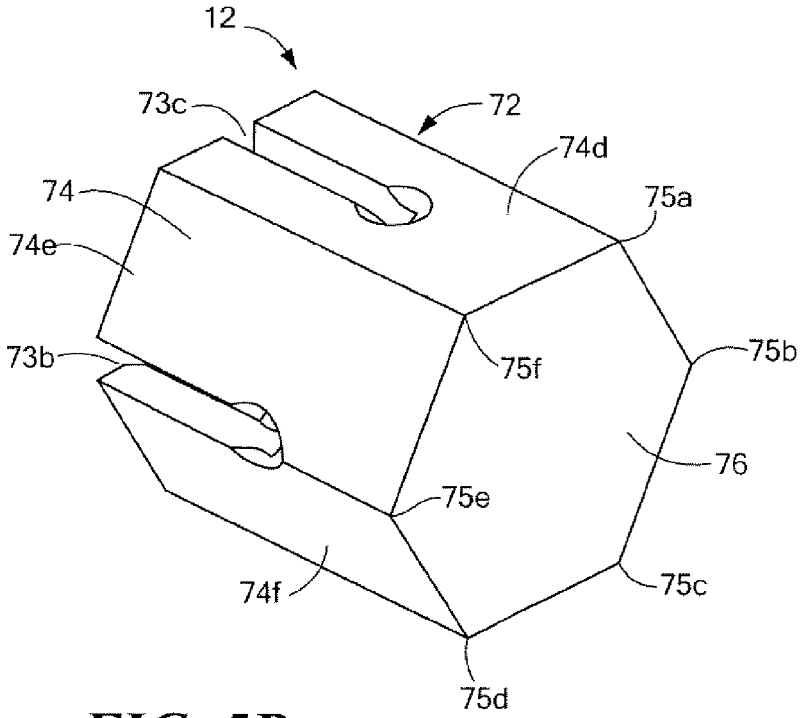
FIG. 5B is a schematic front view of the hard point portion shown in FIG. 5A.

FIGS. 5A and 5B more clearly show hard point 12. Forward facing base portion 72 has cavity 70 receiving post or plug 68, FIG. 4 therein in a friction fit manner. This hard point is designed for nets including horizontal chords intersecting vertical chords. See FIGS. 1, 3 and 4. In this preferred design, the net chords are received through slots 73*a-d* in wall 74 of hard point 72. The slots, as shown for slot 73*a*, terminate in rounded portion 77 preventing wear of the net chords. Wall 74 in this embodiment defines a six-sided structure with six sharp corners 75*a*-75*f* which dig into the skin of an RPG ogive. Top surface 76 may be flat as shown or concave. Slots 73*a* and 73*c* receive a vertically extending chord while slots 73*d* and 73*b* receive a horizontally extending chord. In one specific design, the hard point and the plug were made of steel, hard point 72 was 0.625 inches from one edge to an opposite edge, and 0.72 inches tall. Cavity 70 was 0.499 inches in diameter and 0.34 inches deep. Five gram cylindrical plug 68, FIG. 4 was 0.35 inches tall, 0.500 inches in diameter and may include knurling on the outer wall surface thereof.

Side walls 74*a*-74*f*, FIGS. 5A-5B extend rearward from front face 76 defining cavity 70 surrounded by the side walls. Opposing sidewalls 74*a* and 74*d* have slots (73*a*, 73*c*) in the middle of each side wall. Slots 73*d*, and 73*b*, in turn, are between adjacent sidewalls 74*b* and 74*c* and 74*f* and 74*e*, respectively. Sidewall 74*b* and 74*c* are between opposing sidewalls 74*a* and 74*b* on one side of member 72 while sidewall 74*f* and 74*e* are between opposing sidewalls 74*a* and 74*d* on the opposite side of member 72'.

In this specific design, the base portion 72 and plug were made of hardened steel (e.g., ASTM A108 alloy 12L14) and combined weighed between 10 and 80 grams. A base portion with more or less sides is also possible. For a six sided design, the area of face 76, FIG. 5B, is typically about 0.5 in.$^2$, e.g. between 0.1 and 0.8 in.$^2$. Sidewalls 74*a-f* typically have an area of 0.37 in.$^2$, e.g., between 0.1 and 0.8 in.$^2$. Slots 73*a-d* may be 0.05-0.15 inches wide and between 0.2 and 0.8 inches long.

Manufacturing of a net with hard points in accordance with the subject invention is thus simplified. A net node is placed in cavity 70, FIG. 5A with the net chords exciting through slots 73*a*-73*d* and a plug is then driven in to cavity 70 to lock the node of the net in the hard point. The hard points are typically made of conductive material and may include a protective rust resistant non-reflective, conductive coating (zinc plating, flat olive in color). In one example shown in FIGS. 5A-5B, base portion 72 weighed 30 grams and was machined from 0.625 hex bar stock. Walls 74*a*-74*f* were 0.72" tall. Slots 73*a*-73*d* were 0.080 inches across and 0.350" in length. These dimensions will vary, however, depending on the design of the net.

There are trade offs in the design of the hard points and also the net. The aspect ratio of the hard points, their size, center of gravity, mass, and the like all play an important role. Hard points which are too large, for example, and a net mesh size which is too small, results in too much surface area to be stricken by an RPG, possibly detonating the RPG. Hard points which are too small may not sufficiently damage the RPG ogive and dud the RPG. Steel is a good material choice for the hard points because steel is less expensive. Tungsten, on the other hand, may be used because it is heavier and denser, but tungsten is more expensive. Other materials are possible. The hard points may be 0.5 inch to 0.75 inches across and between 0.5 inches and 1 inch tall.

It is preferred that the net node is placed at the center of gravity at the hard point. The length of the hard point is preferably chosen so that when an RPG strikes the net, the hard point tumbles 90 degrees and digs into the RPG ogive. The moment of inertia of the hard point is designed accordingly. In still other designs, the hard point may have more or less than six sides. The hard points may weigh between 10 to 80 grams although in testing 60 grams was found to be optimal, e.g., a 30 gram base portion and a 30 gram plug. Hard points between 10 and 40 grams are typical.

The net material may be polyester which provides resistance to stretching, ultraviolet radiation resistance, and durability in the field. Kevlar or other engineered materials can be used. A knotted, knotless, braided, or ultracross net may be used. The chord diameter may be 1.7 to 1.9 mm. Larger net chords or multiple chords are possible; however, the chord(s) design should be constrained to beneath threshold force to dynamic break loads typical of RPG impact and engagements. The typical net mesh size may be 176 mm (e.g., a square opening 88 mm by 88 mm) for a PG-7V RPG and 122 mm for a PG-7 VM model RPG. But, depending on the design, the net mesh size may range from between 110 and 190 mm.

The preferred spacing or standoff from the net to the vehicle is between 4 and 24 inches, (e.g., 6-12 inches) but may be between 4 and 60 centimeters. Larger standoffs may extend the footprint of the vehicle and thus be undesirable. Too close a spacing may not insure closing of the electrical circuitry of the RPG ogive by the hard points. The struts and the like are designed to result in the desired spacing. It is desirable that the net material and mesh size be chosen and the net designed such that an RPG ogive, upon striking a net chord, does not detonate. RPGs are designed to detonate at a certain impact force. Preferably, the breaking strength of the net chord material is around 240 lbs so that an RPG, upon striking a net chord or chords, does not detonate. The net is thus designed to be compliant enough so that it does not cause detonation of the RPG. Instead, the hard points dig into the RPG ogive and dud the RPG before it strikes the vehicle or structure.

This design is in sharp contrast to a much more rigid chain link fence style shield which causes detonation of the RPG if the RPG strikes a wire of the fence. The overall result of the subject invention is a design with more available surface area where duding occurs as opposed to detonation.

Figure 6:
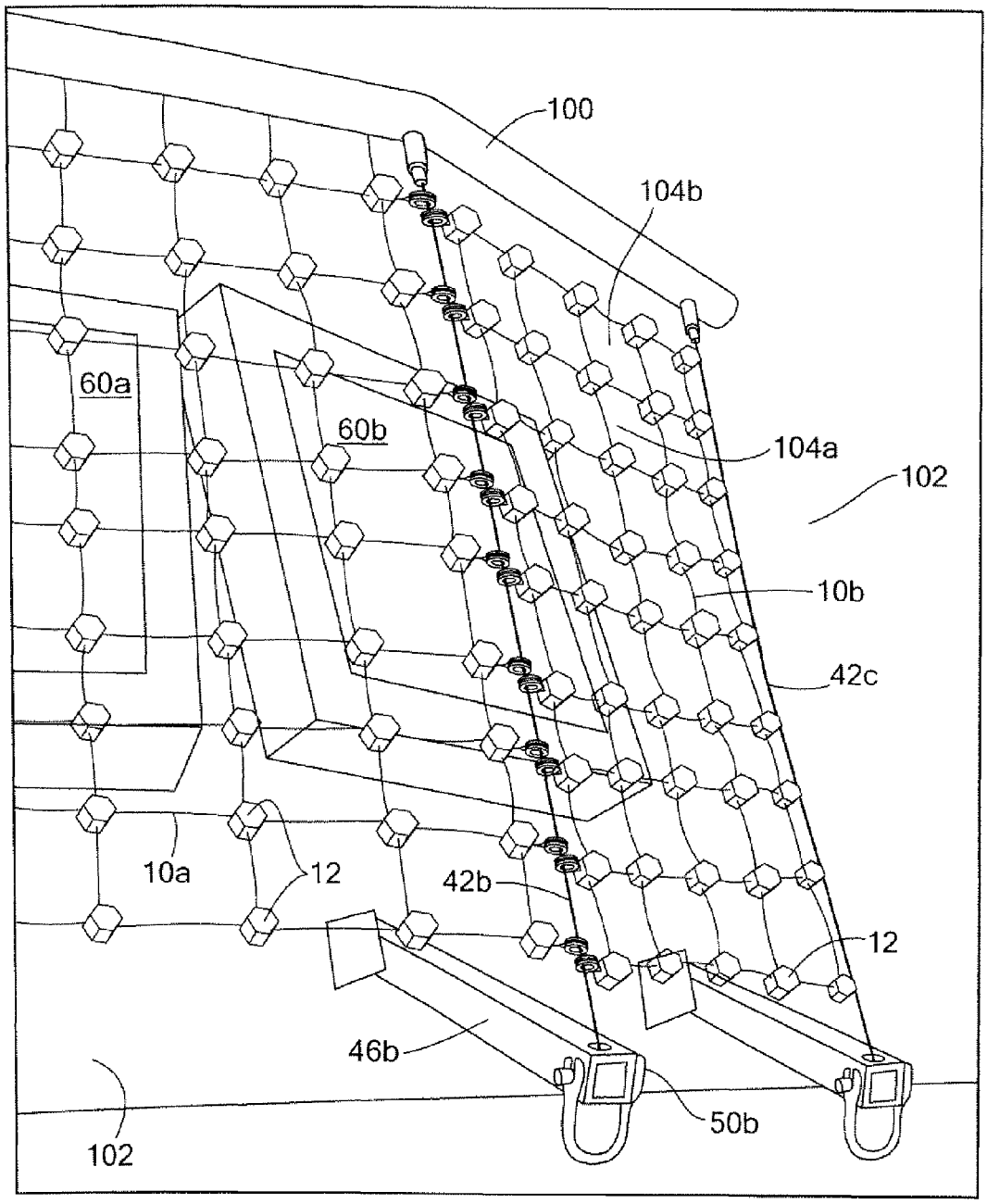
FIG. 6 is a schematic three-dimensional front view showing additional structure associated with the two nets shown in FIG. 3.

FIG. 6 shows another design with top cross member 100 attached to vehicle 102 over portals 60*a* and 60*b* via rearwardly extending top struts such as struts 104*a* and 104*b*. Cross member 100 supports the top of both nets 10*a* and 10*b* (with or without a fabric border) and also the top of cable 42*b*, cable 42*c*, and the like. Velcro and the like can be used to secure the top of the nets 10*a* and 10*b* to cross member 100.

Figure 7:
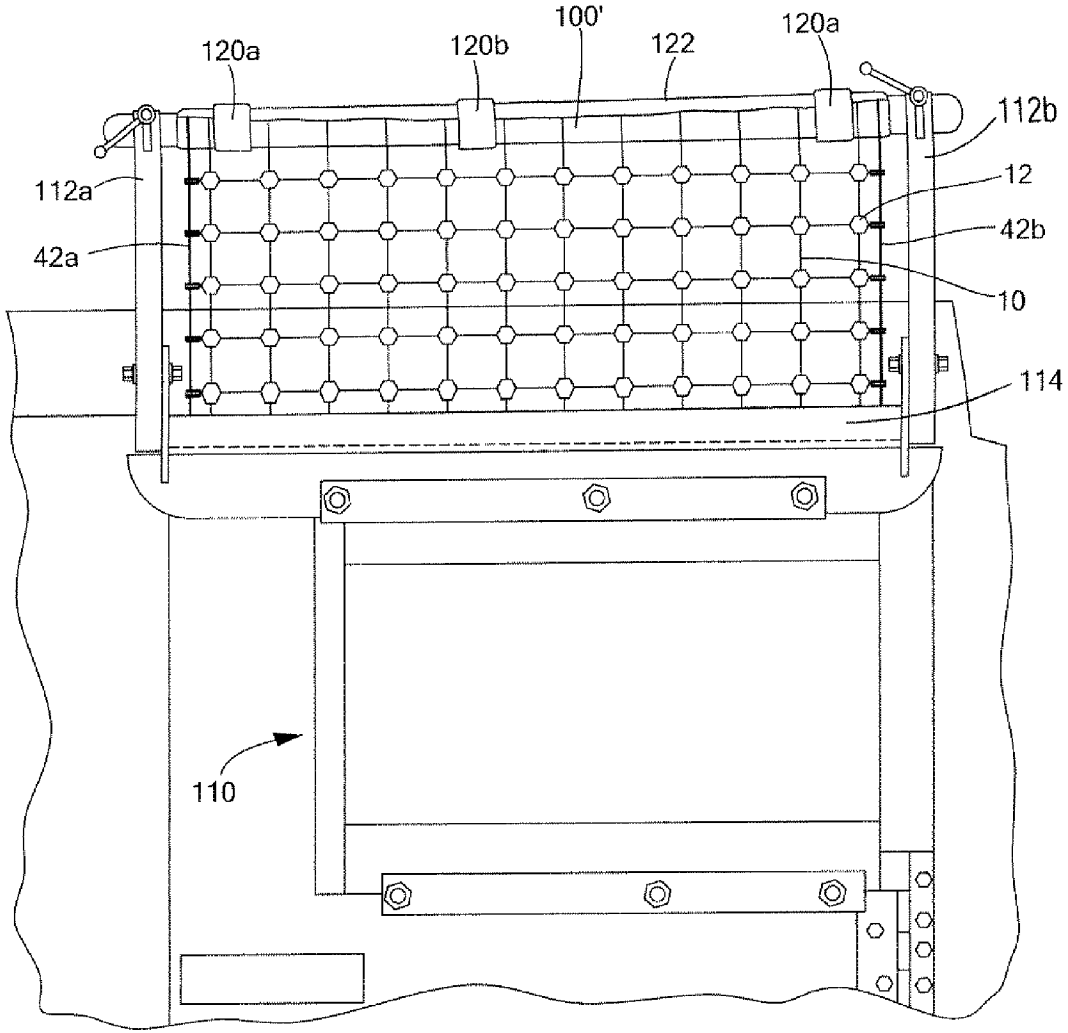
FIG. 7 is a schematic three-dimensional front view showing an example of a hinged and pivotable frame structure and a net folded up in a tray in accordance with an example of the subject invention.

FIG. 7 shows door 110 of the vehicle and top cross member 100' supported over door 110 attached to the vehicle by pivoting top struts 112*a* and 112*b* which can be quickly locked in place and then released. Hard point net 10 can thus be stored in tray 114 which is positioned over door 110. Cables 42 are supported by top frame member 100' and at both bottom ends by members such as struts 46*a*, 46*b*, FIG. 3. In this way, a hard point net or other flexible shield can be deployed and also quickly stowed for ingress and egress through door 110, FIG. 7, for various maneuvers, staging operations, and the like. Velcro wraps 120*a*, 120*b*, and 120*c* are also shown in FIG. 7 for securing net fabric periphery 122 about folding top cross member 100'.

The result, in various embodiments, is a lighter weight system which is easy to deploy and then deactivate and stow. In some embodiments, coverage of the hard points is also improved.

Figure 8:
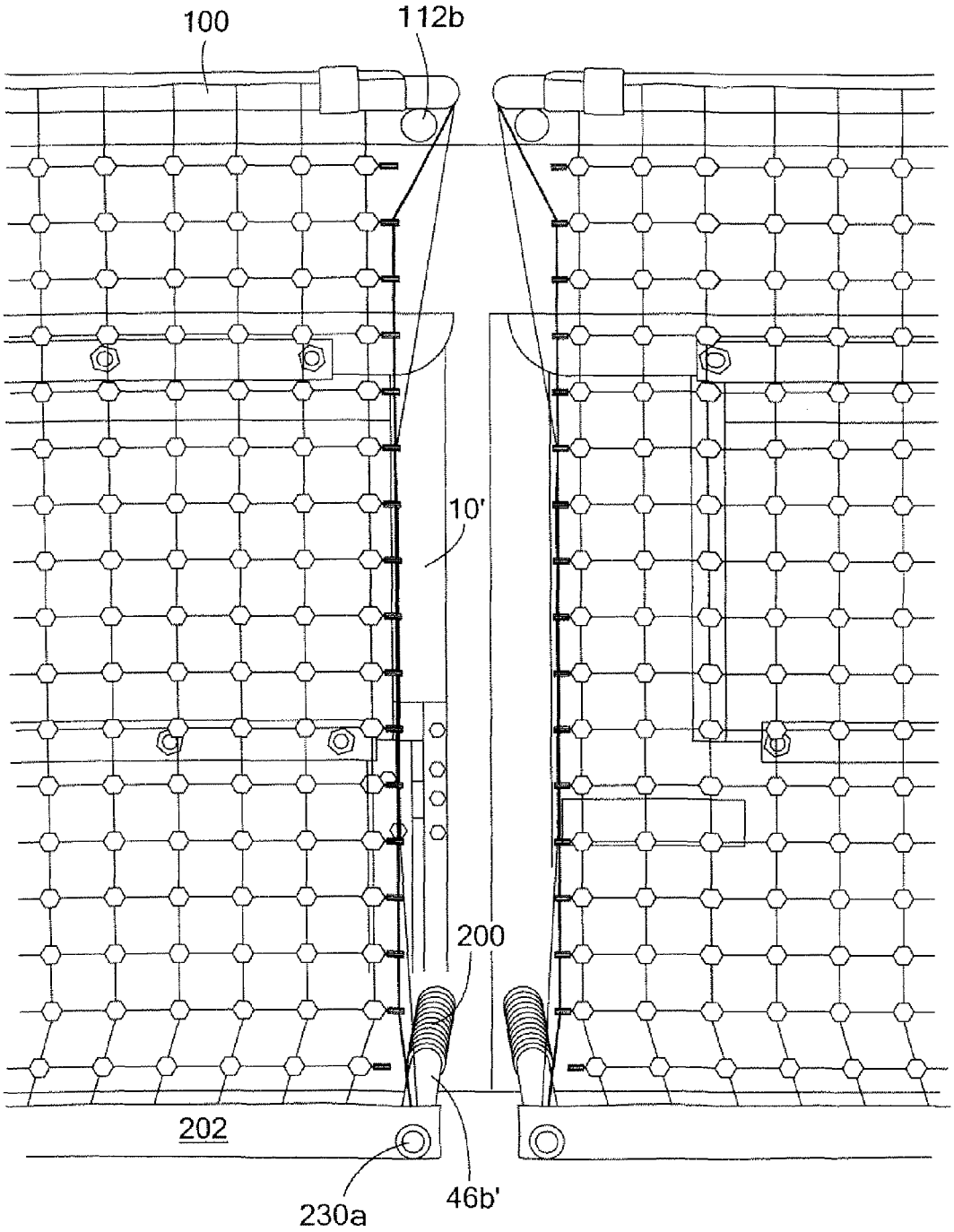
FIG. 8 is a schematic depiction showing an example of a hard point net over a door of a military vehicle in accordance with another example of the invention.

FIG. 8 shows an example for a vehicle door net shield including top cross bar 100" pivotably secured over the door via spaced top struts foldably connected to the vehicle body or roof and extending rearwardly of top cross bar 100 as shown, for example, for top strut 112*b*. The bottom struts such as strut 46*b*' are foldable and may include shock absorbing portion 200. Here, the net 10' includes fabric bottom 202. Top cross bar 100" includes therein spring loaded tensioning member 206, FIG. 9 and cable redirecting structure 207. Cable 208 is secured to tensioner 206, extends out of top cross bar 100" as shown at 210 and extends through the top third or so of the eyelets as shown at 212 skipping the middle third eyelets as shown at 214 and then again extends through the bottom third or so of the eyelets as shown at 216 on the right hand side of net shield 10. The cable then extends through a cable retainer discussed below with reference to FIG. 11, through fabric bottom portion 202, through another cable retainer, and up through the bottom third group of eyelets 218 or so on the left hand side of net shield 10, skipping the middle third group of eyelets 220, and extending through the top third or so of the eyelets 222 on the left hand side of net shield 10, again into top cross bar member 100', around cable redirecting mechanism 207. Then, as shown at 224, cable 208 skips the top third or so of the eyelets on the left hand side of net shield 222, extends through the middle third group of eyelets 220, and skips the bottom third group of eyelets or so on the left hand side of net shield 218. The cable then extends back through the cable retainer at the bottom left hand side of the net, through fabric portion 202, through the cable retainer on the right hand side of the bottom of the net, and then skips the bottom third eyelets or so as shown at 216, extends through the middle third group of eyelets as shown at 214, skips the top third group of eyelets or so as shown at 212, and, as shown at 226, the cable enters the right hand side of top cross bar member 100" and is secured to tensioning member 206.

Figure 9:
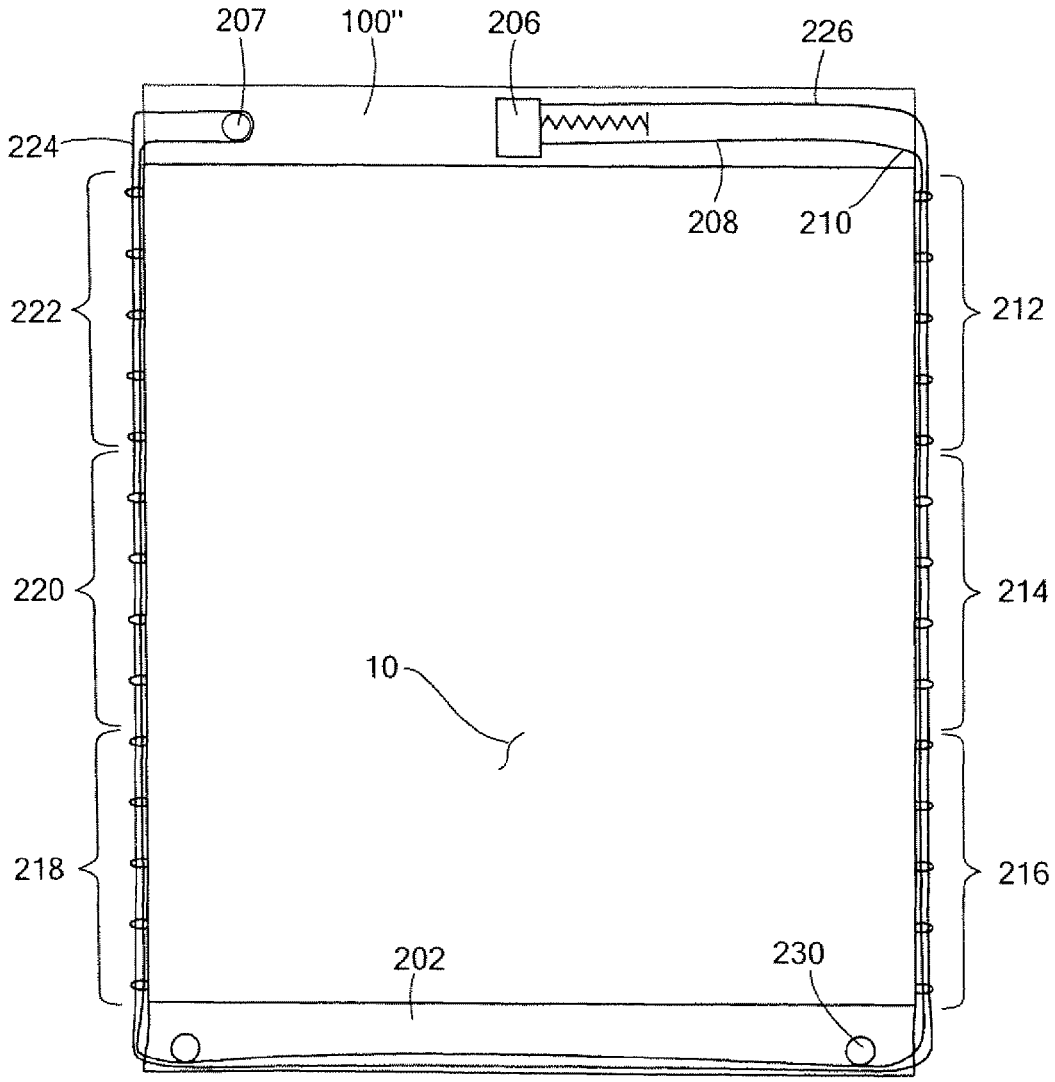
FIG. 9 is a highly schematic view showing how the cabling of the hard point net shown in FIG. 8 is routed through the eyelets of the net in order to prevent hour glassing of the hard point net.
Figure 10:
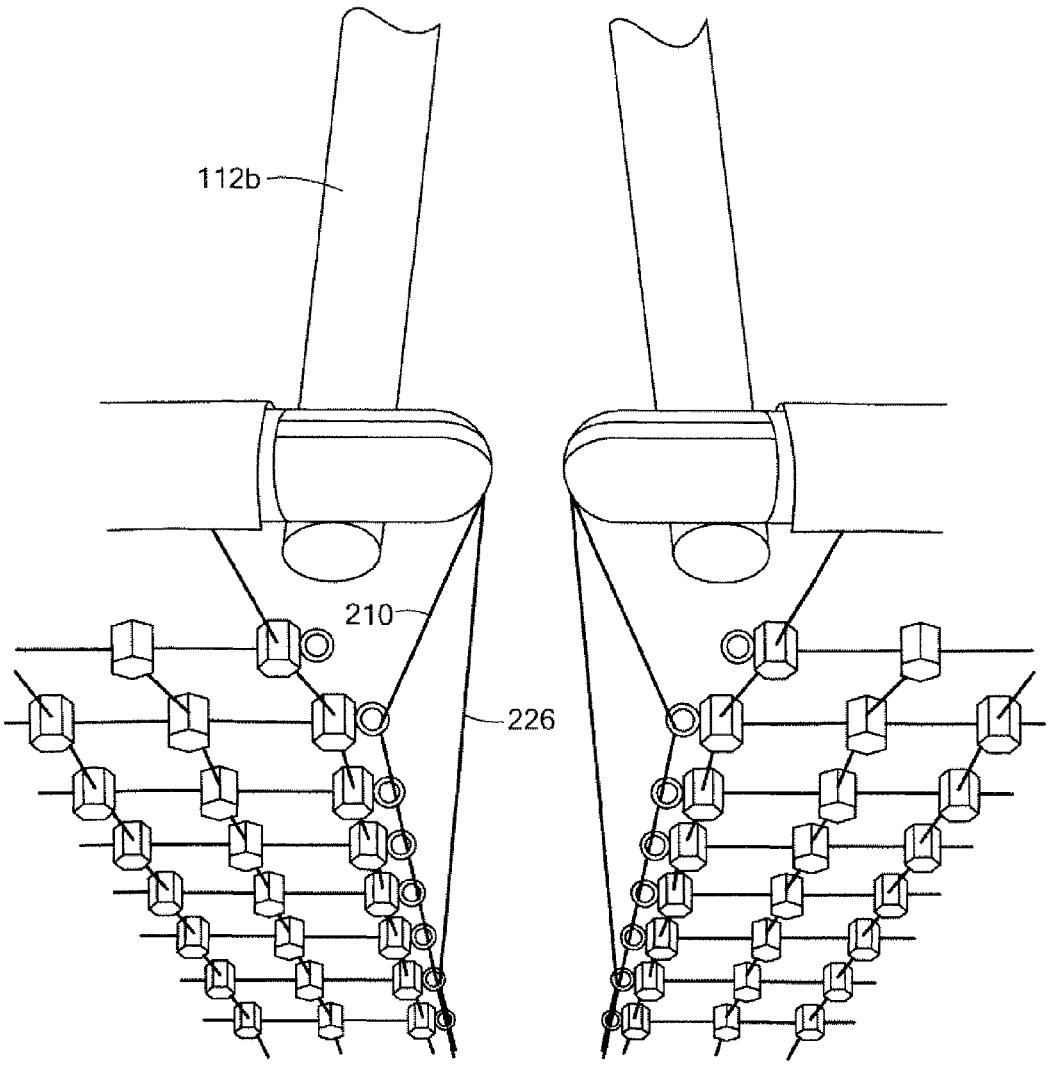
FIG. 10 is a schematic enlarged depiction showing a portion of the top of the hard point net shown in FIG. 8.
Figure 11:
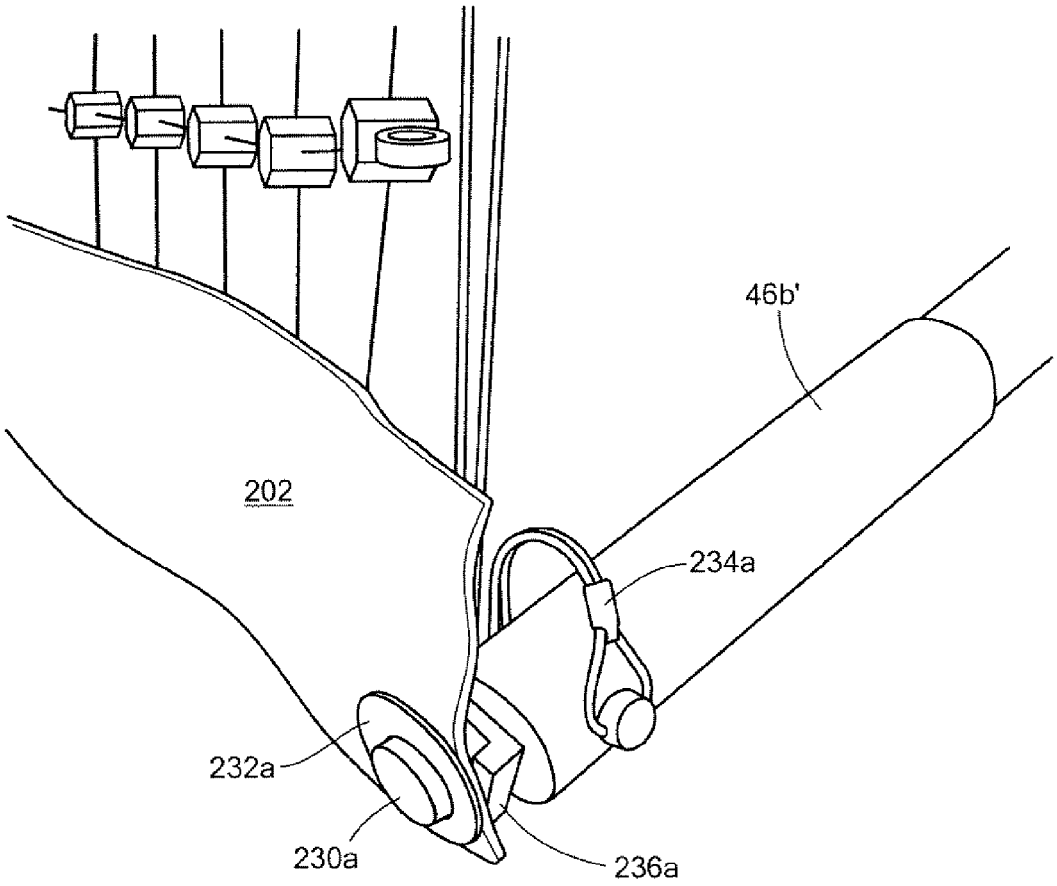
FIG. 11 is a schematic close-up depiction of a portion of the bottom of the hard point net shown in FIG. 8.
Figure 12:
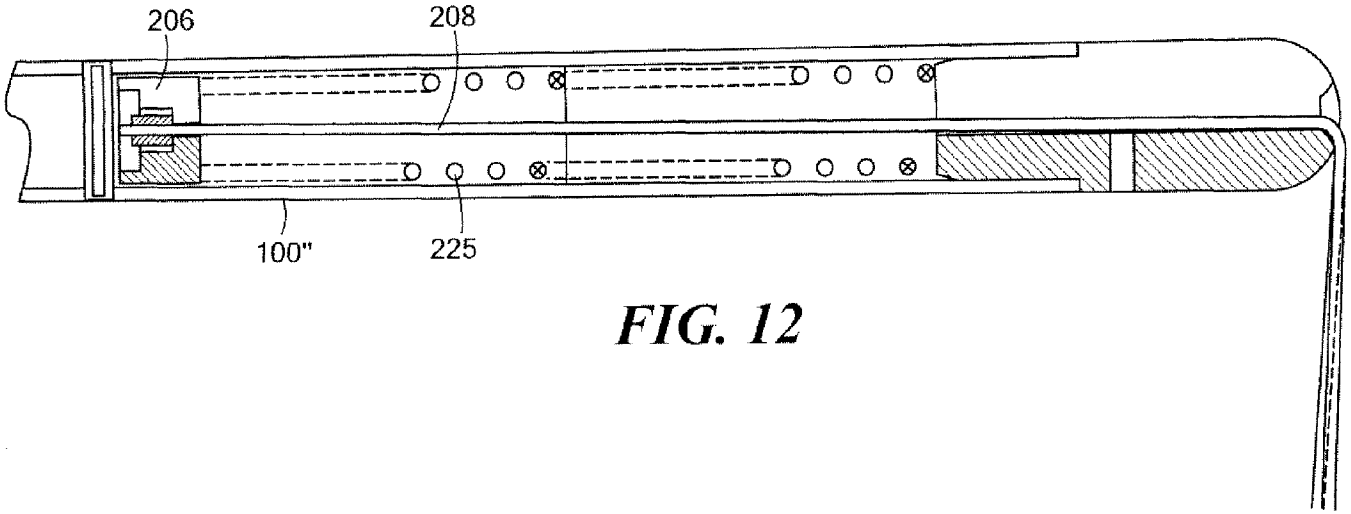
FIG. 12 is a schematic cross-sectional view showing several of the primary components associated with the tensioning subassembly for the net shown in FIG. 8.
Figure 13:
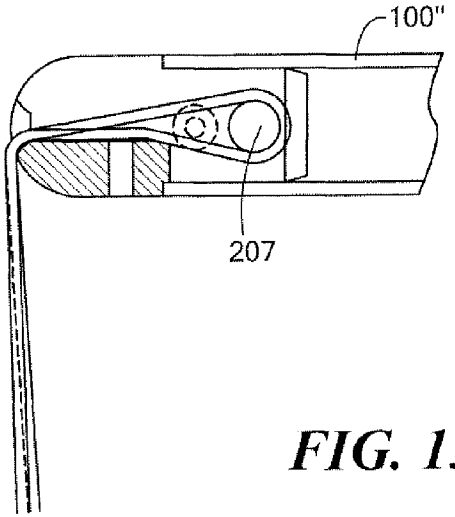
FIG. 13 is a schematic cross sectional depiction of the left hand side of the top cross bar assembly shown in FIG. 12.
Figure 14:
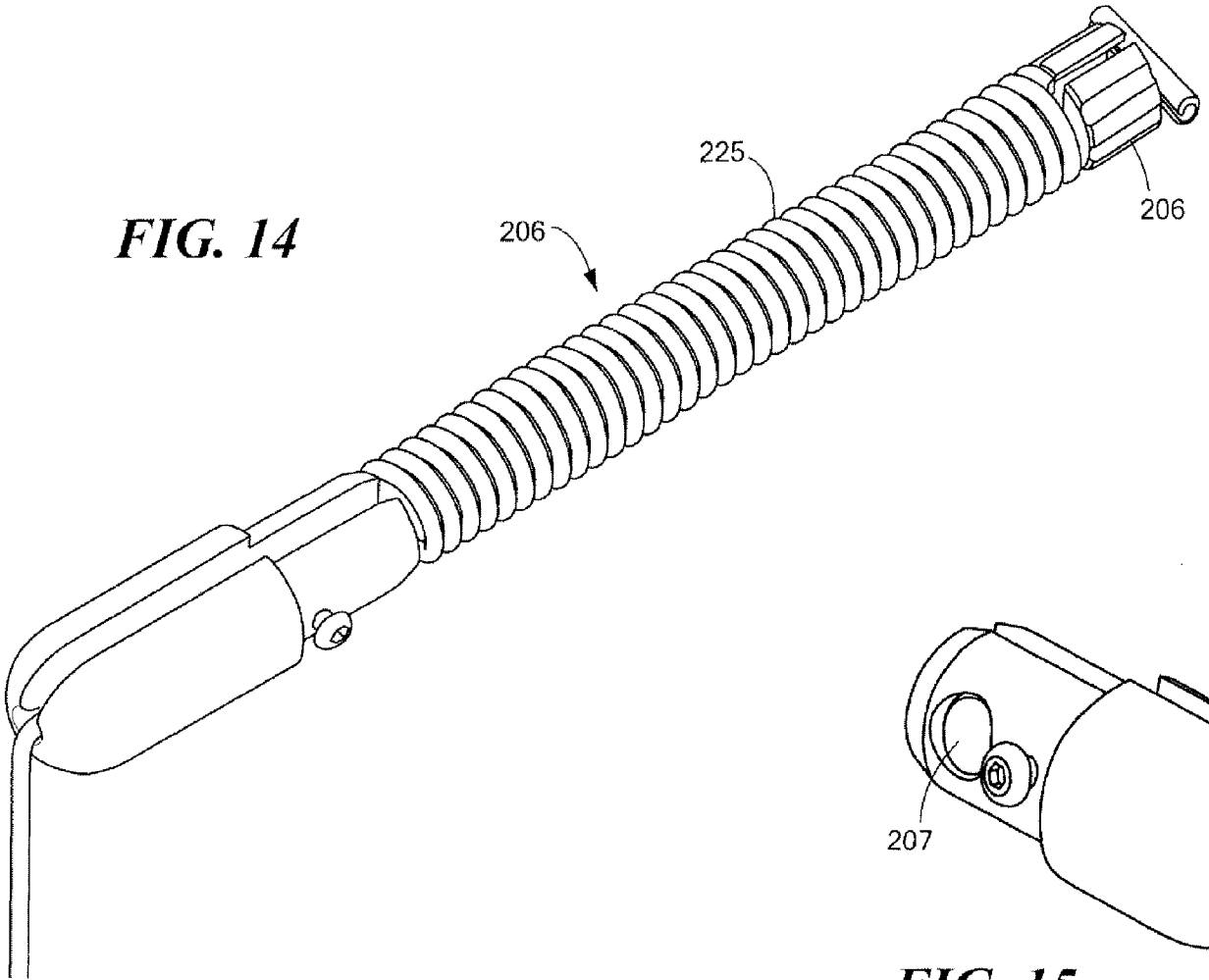
FIG. 14 is a schematic three dimensional view of the cable redirecting structure shown in FIG. 13.
Figure 15:
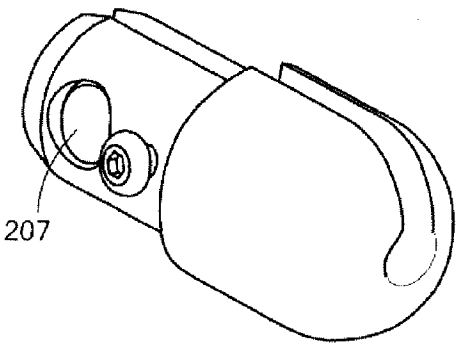
Figure 16:
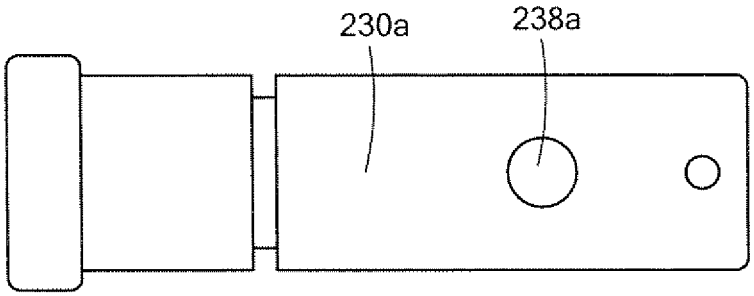
FIG. 16 is a schematic three dimensional side view of a cable retaining pin as shown in FIG. 8.
Figure 17:
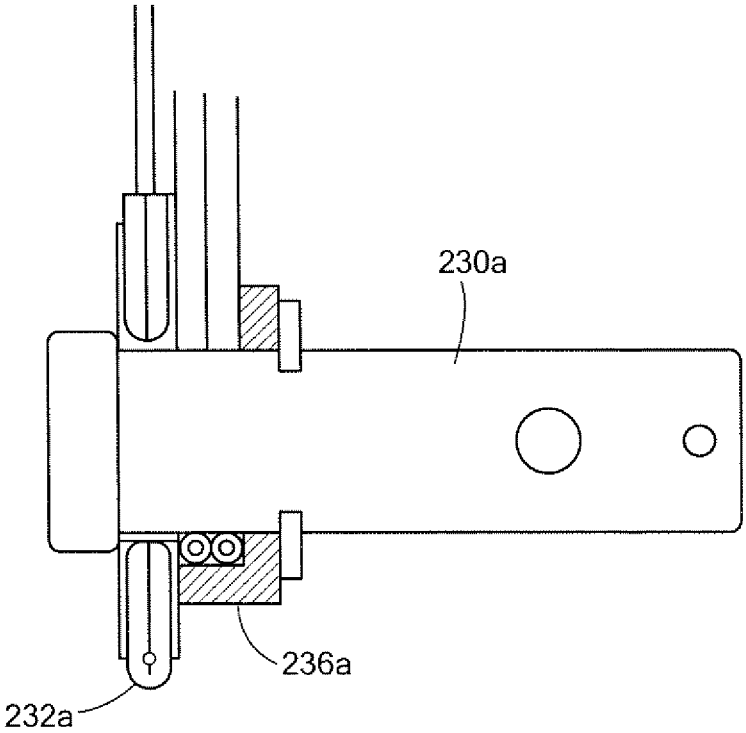
FIG. 17 is a schematic side view of the cable retaining pin shown in FIG. 16 extending through a cable retainer as shown in FIG. 11.

In this manner, hour glassing of the opposing sides of net shield 100 is prevented. FIG. 10 more clearly depicts the cable portion 210 which extends through the top third group of eyelets and cable portion 226 which skips the top third group of eyelets. FIG. 11 depicts pin 230*a* extending through grommet 232*a*, through cable retainer 236*a*, and into bottom strut 46*b*' and secured therein via quick release pin 234*a* extending through hole 238*a*, FIG. 16-17, in pin shaft 230*a*. FIG. 12 shows top cross bar member 100, tensioning mechanism 206 with spring(s) 225 and FIG. 13 more clearly shows cable redirecting member 207 (typically in the form of a pin secured within top cross bar member 100"). FIG. 14 also shows tensioning mechanism 206, spring(s) 225 and slider 226. The cable as shown at FIG. 9 is secured to slider 206 as shown in FIG. 12. FIG. 15 more clearly shows cable redirecting pin 207.

Figure 18:
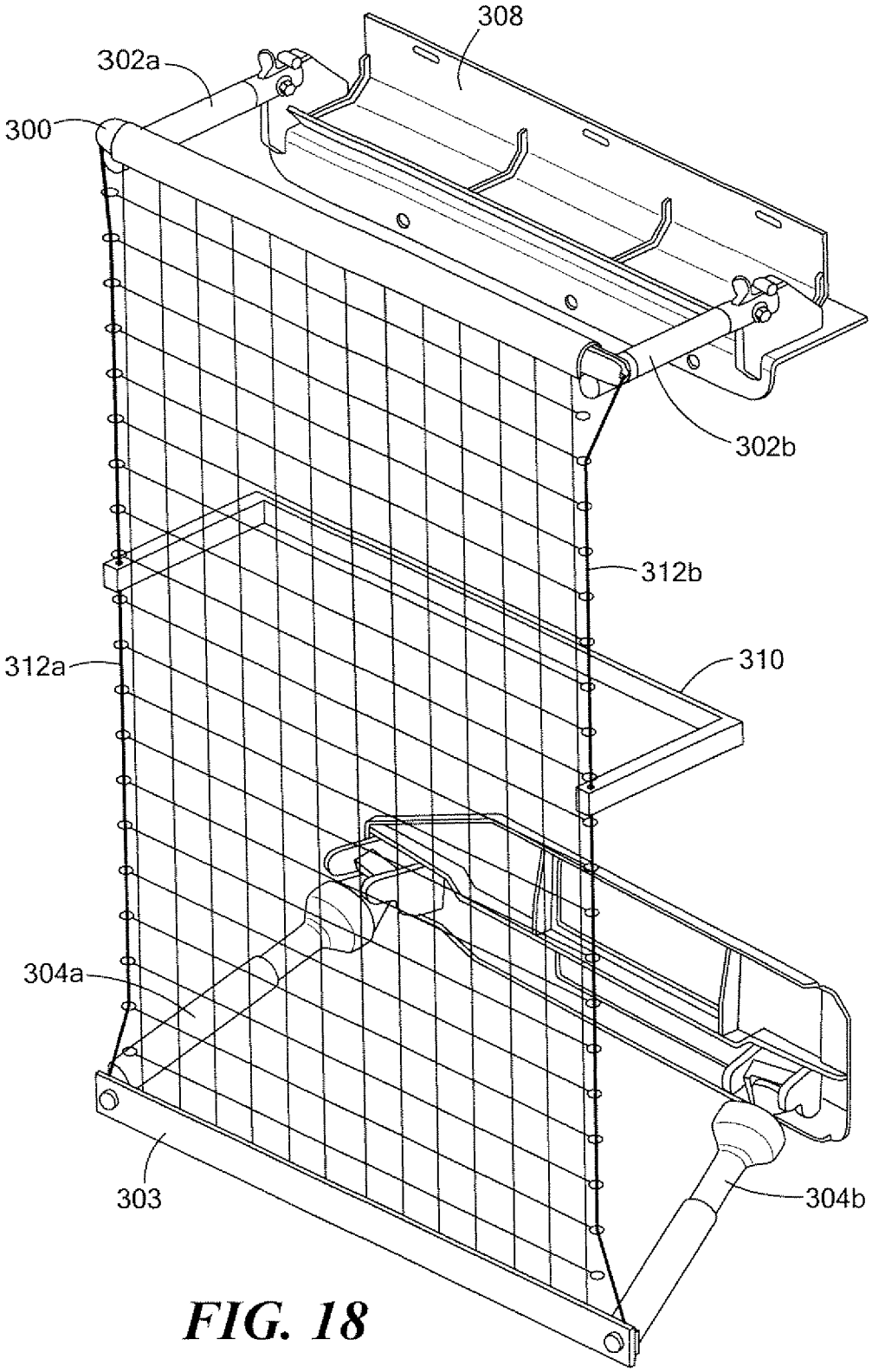
FIG. 18 is a schematic three dimensional view showing another example of a framis for a net shield in accordance with the invention.

FIG. 18 depicts an example with simpler top cross bar 300, folding spaced top struts 302*a* and 302*b* interconnecting top cross bar 300 with tray structure 308 itself securable to a vehicle or structure. Fabric bottom 303 is also shown as are folding bottom struts 304*a* and 304*b*. Member 310, in this example, between the vehicle or structure and the net, is configured to tension cable sides 312*a* and 312*b* apart to prevent hour glassing. Member 310 may be a slat or bar type structure which rests against the vehicle or structure.

Figure 20:
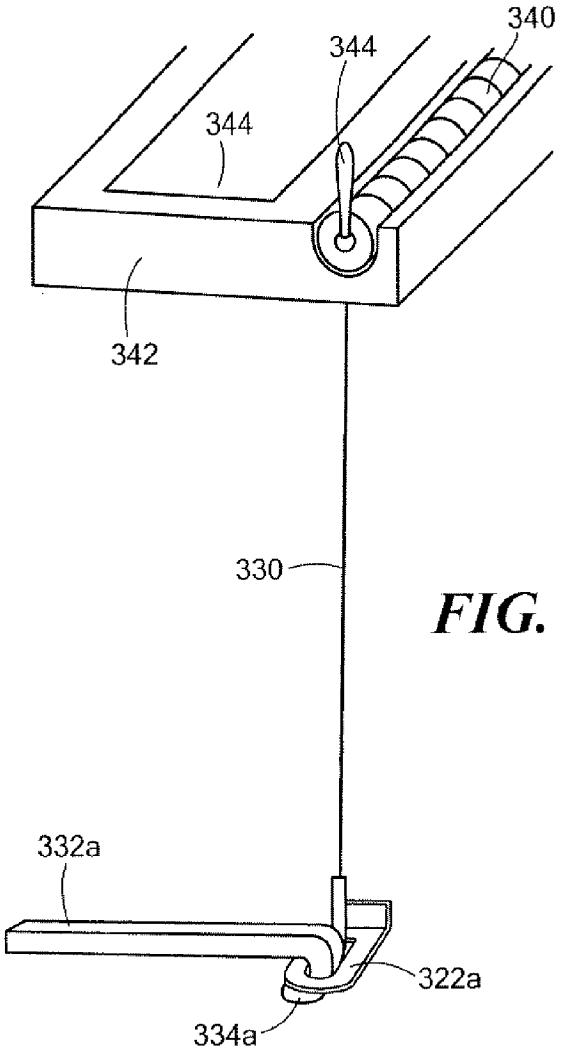
FIG. 20 is a schematic depiction showing one side of still another framis structure for the net shield shown in FIG. 19.
Figure 19:
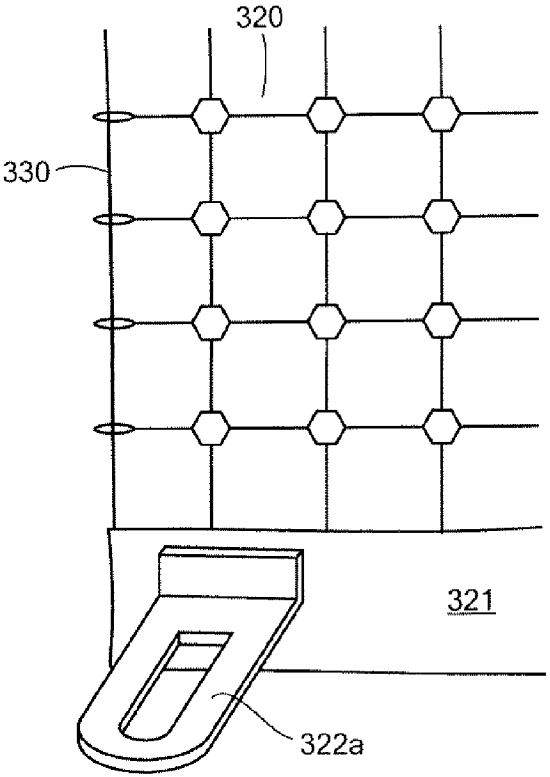
FIG. 19 is a schematic depiction showing a portion of the bottom of a net shield in accordance with another example of the invention.

In FIG. 19, net 320 includes bottom fabric portion 321 with spaced buckles such as buckle 320*a* attached thereto. The sides of the net again include a cable as shown for cable 330. The framis for this version includes spaced, typically foldable bottom struts as shown for strut 322*a* with hook portion 334*a* releasably receiving buckle 322 therein. Each side cable then extends to top cross member 340 which is configured to tension the side cables. For example, top cross bar member 340 may be configured to roll with respect to frame portion 342 via handle 344 in order to tension cable 330 by winding it about the top cross bar member after which handle 334 could be locked with respect to structure 332 which, as discussed above, typically includes net storage tray 344. This may be similar to a window shade type device. In still other examples, the net shield is extended and retracted in a manner which is similar to awnings on trailers. See U.S. Pat. Nos. 6,494,246 and 5,192,111 incorporated herein by this reference. In the example shown in FIGS. 19 and 20, handle 344 is released, the side cables such as cable 330 is released from being in a state of tension, and buckle 322*a* is easily removed from bottom strut 322*a* in order to fold net shield 320, FIG. 19 up into tray 344.

Figure 21:
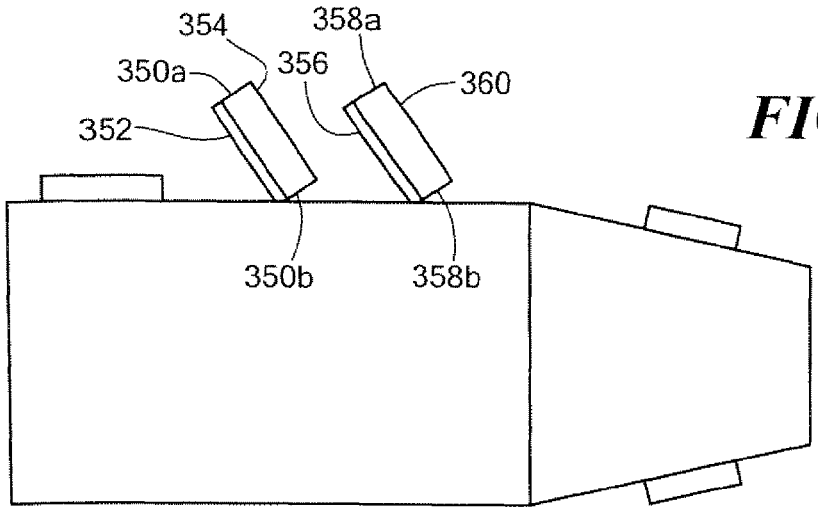
FIG. 21 is a schematic top view showing an example of net shield systems attachable to adjacent doors of a military vehicle in accordance with the invention.
Figure 22:
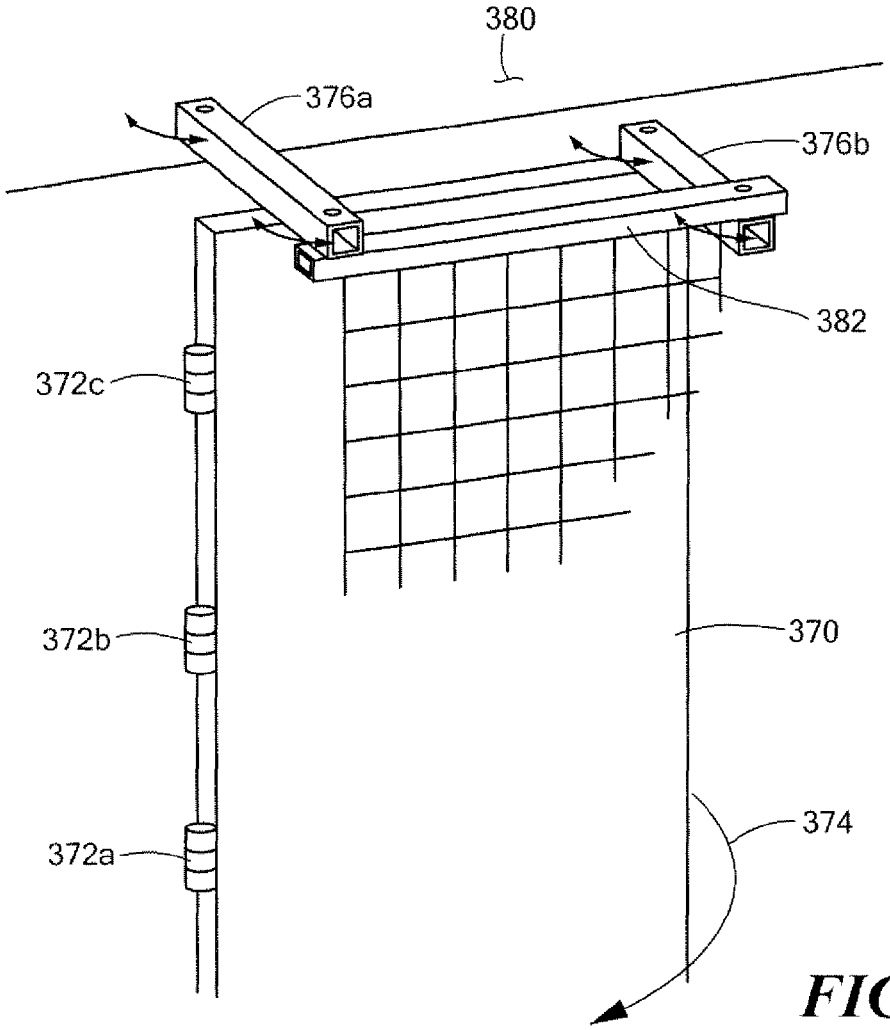
FIG. 22 is a schematic depiction showing a unique method of attaching a top cross member net shield supporting structure to the door of a vehicle and the vehicle itself.

FIG. 21 shows an example where spaced top struts 350*a* and 350*b* attached to door 352 to secure cross member 354 thereto may interfere with door 356 when both doors are open. As shown, door 356 typically also includes spaced top struts 358*a* and 358*b* supporting top cross bar 360. In order to address this potential problem, FIG. 22 shows a design for door 370 of a vehicle or structure hinged thereto via hinges 372*a*, 372*b*, and 372*c* and opened in the direction shown by arrow 374. In this design, top strut 376*a* is pivotable with respect to vehicle body, roof, or structure 380 and pivotable with respect to top cross bar member 382. Strut member 376*a* may also be foldable upwards with respect to structure 380 and/or releasable from cross bar member 382. Top strut member 376*b*, in contrast, is secured to and pivotable with respect to the top of door 370 and also pivotable with respect to cross bar member 382. As in previous designs, cross bar member 382 supports the top of a net shield. The bottom of the net can be supported by struts as shown, for example, with respect to FIG. 8 attached to the bottom of door 370. In this way, if there are adjacent doors in the vehicle, then the net shield frame for one door will not interfere with the net shield frame of the adjacent door when one or both of the doors are open.

Figure 23:
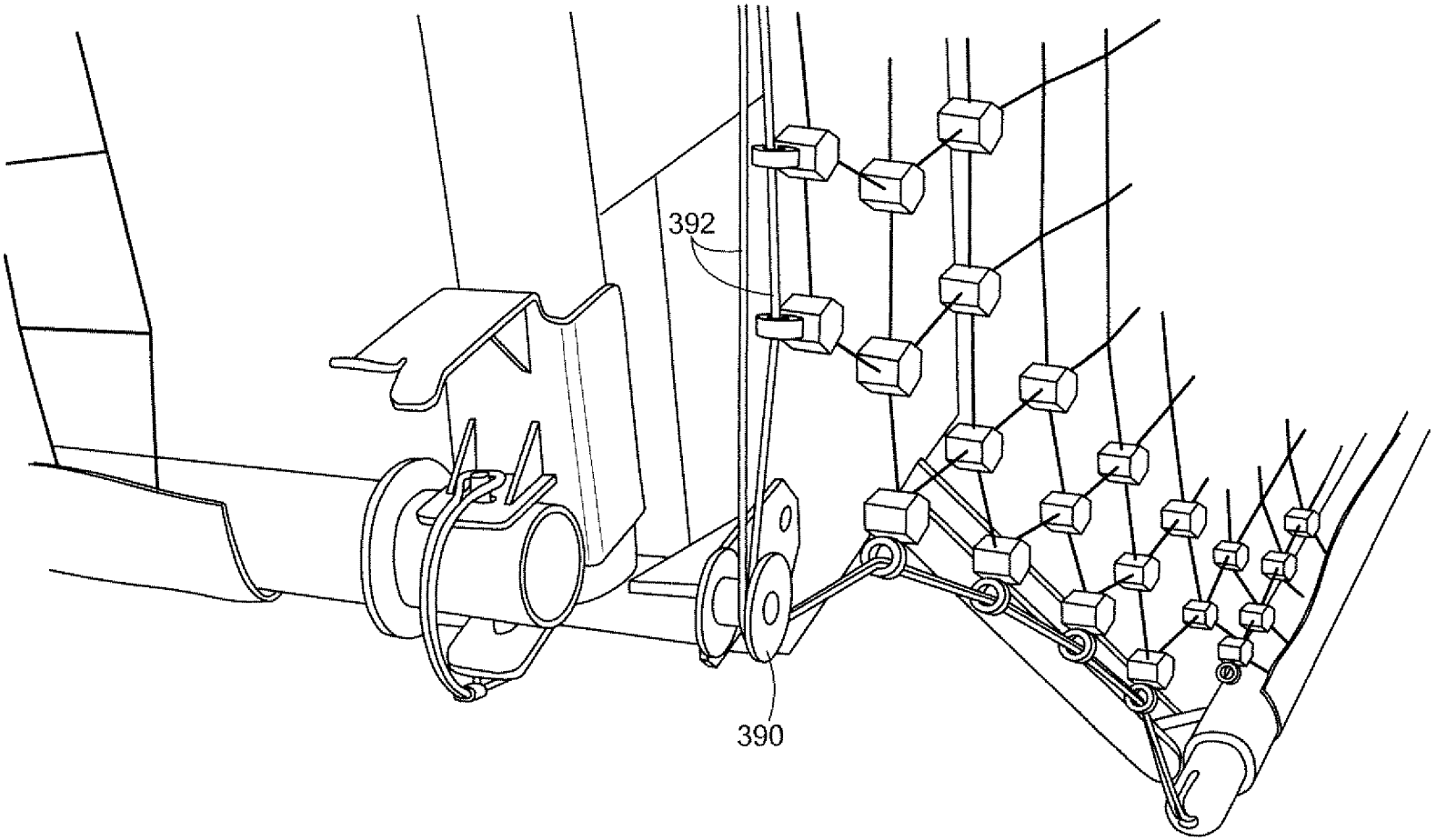
FIG. 23 is a schematic depiction showing a supplemental pulley for tensioning one or more cables supporting a net shield in accordance with still another example of the invention.

FIG. 23 shows an example where an extra cabled pulley 390 is provided attached to a portion of the vehicle in order to tension a side cable or cables as shown at 392.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A shield comprising:

a net including hard points at select nodes of the net;

one or more sides of the net including a plurality of cable guides;

at least one cable under tension through the cable guides supporting the net; and spaced top struts interconnecting a top cross bar supporting the net with a vehicle or structure, said spaced top struts foldable with respect to the vehicle.

2. The shield of claim 1 in which said cable guides include eyelets.

3. The shield of claim 2 in which said eyelets include a peripheral groove for receiving net material therein.

4. The shield of claim 3 in which said hard points include a body portion with a cavity and a plug received in the cavity.

5. The shield of claim 1 in which said hard points include slots in the body portion for the net material.

6. The shield of claim 1 in which the top cross bar includes a tensioning mechanism for the cable.

7. The shield of claim 1 in which the vehicle or structure includes a door and both top struts are connected to the door.

8. The shield of claim 1 in which the vehicle or structure includes a door and one top strut is connected to the door and one top strut is connected to the vehicle or structure.

9. The shield of claim 8 in which the top struts are pivotable with respect to the top cross bar and with respect to the door or vehicle structure.

10. The shield of claim 1 further including spaced bottom struts for opposing sides of the net.

11. The shield of claim 10 in which the bottom struts are foldable with respect to a vehicle or structure.

12. The shield of claim 10 in which each bottom strut includes a shock absorbing device.

13. The shield of claim 10 in which each bottom strut is connected to a net cable.

14. The shield of claim 13 in which the net cable is removable from its bottom strut.

15. The shield of claim 14 further including a pin removably received in a bottom strut and connected to the net.

16. The shield of claim 15 in which the net includes a bottom fabric portion.

17. The shield of claim 1 in which a cable extends through cable guides of a top and bottom on a first side of the net, over to a second side of the net and through cable guides of a bottom and top on said second side, to the top of the net, then through cable guides of a middle on said second side, then to the bottom of the net, over to the first side of the net, through cable guides of a middle of the first side of the net, and then to the top of the net.

18. The shield of claim 1 further including a member for tensioning sides of the net.

19. The shield of claim 18 in which the member is disposed between the net and a vehicle or structure.

20. The shield of claim 1 further including a tray on a vehicle or structure for storing the net.

21. The shield of claim 1 in which there are cable guides on opposing sides of the net and spaced cables, one on each side of the net.

22. The shield of claim 21 further including an adjacent net with cable guides and a cable extends through the cable guides of both nets.

23. A shield comprising:

a net including hard points at select nodes of the net;

opposing sides of the net including a plurality of cable guides for supporting the net when a cable is provided under tension through the cable guides on each side of the net; and spaced to struts interconnecting a to cross bar supporting the net with a vehicle or structure, said spaced top struts foldable with respect to the vehicle.

24. The shield of claim 23 in which said cable guides include eyelets.

25. The shield of claim 24 in which said eyelets include a peripheral groove for receiving net material therein.

26. The shield of claim 23 in which said hard points include a body portion with a cavity and a plug received in the cavity.

27. The shield of claim 26 in which said hard points include slots in the body portion for the net material.

28. The shield of claim 23 in which the top cross bar includes a tensioning mechanism for the cable.

29. The shield of claim 23 in which the vehicle or structure includes a door and both top struts are connected to the door.

30. The shield of claim 23 in which the vehicle or structure includes a door and one top strut is connected to the door and one top strut is connected to the vehicle or structure.

31. The shield of claim 30 in which the top struts are pivotable with respect to the top cross bar and with respect to the door or vehicle structure.

32. The shield of claim 23 further including spaced bottom struts for opposing sides of the net.

33. The shield of claim 32 in which the spaced bottom struts are foldable with respect to a vehicle or structure.

34. The shield of claim 32 in which each spaced bottom strut includes a shock absorbing device.

35. The shield of claim 23 in which the net includes a bottom fabric portion.

36. The shield of claim 23 further including a member for tensioning sides of the net.

37. The shield of claim 36 in which the member is between the net and a vehicle or structure.

38. The shield of claim 23 further including a tray on a vehicle or structure for storing the net.

39. A method of manufacturing a shield, the method comprising:

securing hard points at select nodes of a net;

adding cable guides to one or more sides of the net;

providing at least one cable under tension through the cable guides to support the net in a spaced relation with respect to a vehicle or structure;

supporting the net by a top cross bar;

interconnecting the top cross bar with a vehicle or structure using spaced top struts; and making the spaced top struts foldable with respect to the vehicle or structure.

40. The method of claim 39 in which said cable guides include eyelets.

41. The method of claim 40 in which said eyelets include a peripheral groove for receiving net material therein.

42. The method of claim 41 in which securing said hard points includes placing a net node in a hard point a body portion cavity and driving a plug into the cavity.

43. The method of claim 39 in which said hard points include slots in the body portion for the net material.

44. The method of claim 39 further including tensioning at least one cable.

45. The method of claim 39 further including supporting the net via spaced bottom struts.

46. The method of claim 45 further including making the bottom struts foldable with respect to a vehicle or structure.

47. The method of claim 45 further including equipping each bottom strut with a shock absorbing device.

48. The method of claim 39 further including providing a bottom fabric portion for the net.

49. The method of claim 39 further including providing a member for tensioning sides of the net.

50. The method of claim 49 including placing the member between the net and a vehicle or structure.

51. The method of claim 39 further including providing a tray on a vehicle or structure for storing the net.

52. The method of claim 39 in which there are cable guides on opposing sides of the net and spaced cables, one on each side of the net.

53. The method of claim 52 further including an adjacent net with cable guides and said cable extends through the cable guides of both nets.

54. A shield comprising:

a net including hard points at select nodes of the net;

one or more sides of the net including a plurality of cable guides;

at least one cable under tension through the cable guides supporting the net; and spaced bottom struts for opposing sides of the net, said spaced bottom struts foldable with respect to the vehicle or structure.

55. A shield comprising:

a net including hard points at select nodes of the net;

one or more sides of the net including a plurality of cable guides;

at least one cable under tension through the cable guides supporting the net; and spaced bottom struts for opposing sides of the net, said spaced bottom struts each including a shock absorbing device.

56. A shield comprising:

a net including hard points at select nodes of the net;

one or more sides of the net including a plurality of cable guides;

at least one cable under tension through the cable guides supporting the net, in which the cable extends through cable guides of a top and bottom on a first side of the net, over to a second side of the net and through cable guides of a bottom and top on said second side, to the top of the net, then through cable guides of a middle on said second side, then to the bottom of the net, over to the first side of the net, through cable guides of a middle of the first side of the net, and then to the top of the net.

57. A shield comprising:

a net including hard points at select nodes of the net;

one or more sides of the net including a plurality of cable guides;

at least one cable under tension through the cable guides supporting the net; and spaced bottom struts for opposing sides of the net in which each bottom strut is connected to a net cable.

58. The shield of claim 57 in which the net cable is removable from the bottom strut.

59. The shield of claim 58 further including a pin removably received in a bottom strut and connected to the net.

60. The shield of claim 59 in which the net includes a bottom fabric portion.

61. A shield comprising:

a net including hard points at select nodes of the net;

opposing sides of the net including a plurality of cable guides for supporting the net when a cable is provided under tension through the cable guides on each side of the net; and spaced bottom struts for opposing sides of the net, in which the spaced bottom struts are foldable with respect to a vehicle or structure.

62. A shield comprising:

a net including hard points at select nodes of the net;

opposing sides of the net including a plurality of cable guides for supporting the net when a cable is provided under tension through the cable guides on each side of the net; and spaced bottom struts for opposing sides of the net, said spaced bottom struts each including a shock absorbing device.

63. A method of manufacturing a shield, the method comprising:

securing hard points at select nodes of a net;

adding cable guides to one or more sides of the net;

providing at least one cable under tension through the cable guides to support the net in a spaced relation with respect to a vehicle or structure;

supporting the net via spaced bottom struts; and making the bottom struts foldable with respect to a vehicle or structure.

64. A method of manufacturing a shield, the method comprising:

securing hard points at select nodes of a net;

adding cable guides to one or more sides of the net;

providing at least one cable under tension through the cable guides to support the net in a spaced relation with respect to a vehicle or structure;

supporting the net via spaced bottom struts; and equipping each bottom strut with a shock absorbing device.

65. A method of manufacturing a shield, the method comprising:

securing hard points at select nodes of a net;

adding cable guides to one or more sides of the net;

providing at least one cable under tension through the cable guides to support the net in a spaced relation with respect to a vehicle or structure; and providing a bottom fabric portion for the net.

66. A method of manufacturing a shield system for a vehicle or structure, the method comprising:

securing hard points at select nodes of a net;

adding cable guides to one or more sides of the net;

providing at least one cable under tension through the cable guides to support the net in a spaced relation with respect to a vehicle or structure; and providing a tray on the vehicle or structure for storing the net.

* * * * *